US010677522B1

(12) United States Patent
Stauffer et al.

(10) Patent No.: US 10,677,522 B1
(45) Date of Patent: Jun. 9, 2020

(54) MODULAR DESIGN FOR MANUAL OR ELECTRICAL CONTROL OF REFRIGERATOR DRAWER TEMPERATURE

(71) Applicant: Whirlpool Corporation, Benton Harbor, MI (US)

(72) Inventors: David Stauffer, Belle Plaine, IA (US); Dennis Winders, Cedar Rapids, IA (US)

(73) Assignee: WHIRLPOOL CORPORATION, Benton Harbor, MI (US)

( * ) Notice: Subject to any disclaimer, the term of this patent is extended or adjusted under 35 U.S.C. 154(b) by 251 days.

(21) Appl. No.: 13/645,580

(22) Filed: Oct. 5, 2012

(51) Int. Cl.
*F25D 29/00* (2006.01)

(52) U.S. Cl.
CPC ..... *F25D 29/00* (2013.01)

(58) Field of Classification Search
CPC ..... F25D 25/02; F25D 17/04; F25D 11/02; F25D 13/02; F25D 13/04; F25D 25/025; F25D 29/005
USPC ..... 62/125
See application file for complete search history.

(56) References Cited

U.S. PATENT DOCUMENTS 4,850,206 A * 7/1989 Larsen ..... 62/382
5,425,245 A 6/1995 Martin
5,640,856 A 6/1997 Cho
5,901,562 A 5/1999 Tunzi
6,101,819 A * 8/2000 Onaka ..... F25D 29/005 337/327
8,015,839 B2 9/2011 Kang
8,220,286 B2 7/2012 Cushman
8,299,656 B2 * 10/2012 Allard ..... F25D 17/042 307/154
2003/0033824 A1 * 2/2003 Sanna et al. ..... 62/229
2005/0236947 A1 * 10/2005 LeClear ..... A47B 71/00 312/404
2007/0113565 A1 * 5/2007 Evans et al. ..... 62/176.1
2008/0302114 A1 12/2008 Kelly
(Continued)

FOREIGN PATENT DOCUMENTS

CN 2059977 U 8/1990
CN 2221758 Y 3/1996
(Continued)

OTHER PUBLICATIONS

Zhenglie, Refrigerated Air Supply Apparatus for Drawer Type Cold Storage Container of Refrigerator, Feb. 27, 2008, CN101131277A, Whole Document.*
(Continued)

*Primary Examiner* — Larry L Furdge
(74) *Attorney, Agent, or Firm* — Nyemaster Goode, P.C.

(57) ABSTRACT

Flexible system and method of temperature control options for an enclosed space in a refrigerator appliance. A surface at or near the enclosable space includes a universal receiver. Different temperature control modules complementarily fit into the receiver. The manufacturer or user selects between modules of different types for different temperature control features. One module can be simply mechanical adjustment which is mechanically translated to a damper. Another option would be an electronic or electrical interface for the user that would send a signal to a controller that would electrically actuator damper control for temperature control in the enclosed space.

20 Claims, 27 Drawing Sheets

(56) References Cited

U.S. PATENT DOCUMENTS

| | | | | |
|---|---|---|---|---|
| 2008/0302125 | A1 | 12/2008 | Cushman | |
| 2010/0218514 | A1* | 9/2010 | Bertolini et al. | 62/56 |

FOREIGN PATENT DOCUMENTS

| | | | | |
|---|---|---|---|---|
| CN | 2268235 | Y | | 11/1997 |
| CN | 2589904 | Y | | 12/2003 |
| CN | 2881468 | Y | | 3/2007 |
| CN | 101131277 | A | * | 2/2008 |
| CN | 102376476 | A | | 3/2012 |
| JP | 1084081 | A | | 3/1989 |
| JP | 2003176978 | A | | 6/2003 |
| JP | 2008020104 | A | | 1/2008 |
| JP | 2010230307 | A | | 10/2010 |
| KR | 20010017975 | A | | 3/2001 |
| KR | 20040062787 | A | | 7/2004 |
| KR | 20050105340 | A | | 11/2005 |
| KR | 2007016320 | A | | 2/2007 |
| WO | 2003076856 | A2 | | 9/2003 |

OTHER PUBLICATIONS

Seol, The Damper Control Device of the Drawer Type Kimchi Storage Feb. 1998, KR1019980005494, Whole Document.*

* cited by examiner

*(LEFT SIDE)*

*(RIGHT SIDE)*

MODULAR DESIGN FOR MANUAL OR ELECTRICAL CONTROL OF REFRIGERATOR DRAWER TEMPERATURE

BACKGROUND OF THE INVENTION

Field of the Invention

The present invention relates to refrigeration appliances such as refrigerators, refrigerator/freezers, coolers, and the like, and in particular, to temperature control of designated spaces in such an appliance.

Related Art

In its basic form, a refrigeration appliance encloses a space and uses refrigeration techniques to maintain that enclosed space in a temperature range; usually below ambient temperature. The insulated enclosure of the appliance, the cabinet, can define one single refrigeration space. As the technical field advanced, the cabinet was subdivided. One primary example is one subdivided space used for cold foods; the other for frozen foods. This would require management of the removal of heat to different extents from the two subdivided spaces.

Presently, subdivided and special-use spaces and features are increasingly more common with refrigeration appliances. One example is a crisper drawer. In some models, humidity can be controlled in that space. Other drawers, racks, or holders define specialized storage locations in both refrigeration and freezer compartments.

As a whole, the segregated refrigeration and freezer compartments have separate temperature ranges. A typical freezer section temperature range might be between 0-25° F. A refrigeration section might be between 33-43° F. Independent temperature controls, usually located at or near each section, can allow some user control of temperature for each section in some appliances by known refrigeration techniques.

In most modern refrigerator appliances, a programmable controller can sense temperature in the cold fold or freezer sections and instruct operation of the evaporator/condenser or other cooling mechanism to maintain the section within a temperature range appropriate for the section. In some models, the user can adjust the set point for one or more subdivided cabinet sections by a manual or electronic control. The user sets the approximate temperature for cold food section and/or freezer section through such a user interface.

One further feature in some present refrigeration appliances is independent control of temperature within one of the refrigeration or freezer compartments. In other words, the temperature in an enclosed or substantially enclosed space within a larger space of the fresh food compartment or the freezer section can be specifically controlled.

A typical way to accomplish this is to have some sort of damper controlling the type and amount of cold air circulated through that subspace. The damper can be manually adjusted to adjust the opening. Or in some appliances, electrical actuators can be instructed to adjust the size of the opening.

An issue with such a concept is that a manual control has to be separately designed, assembled, and installed with certain dedicated components. The electrical version has a different set of components, design, and installation. While either one can adjust temperature in that subspace apart from temperature of the larger space within which it resides, the subtle issue is that a substantially different set of manufacturing and assemble steps must be taken and substantially different components used to build the manual control as opposed to the electrical control.

It has therefore been discovered there is a need in the art for improvement on this point.

SUMMARY OF THE INVENTION

It is therefore a principle object, feature, aspect, or advantage of the present invention to improve over or solve problems or deficiencies in the art relative to independent control of a subspace of a greater closed compartment of a refrigeration device.

Further objects, features, aspects, or advantages of the present invention relate to control of temperature in an enclosed or substantially enclosed subspace of a greater closed compartment of a refrigeration device, which:

a. allows for efficient and economical manufacturing of refrigeration devices regardless of whether manual or electrical temperature control is desired;
b. allows an efficient and effective way of electrical or electronic temperature control of even a relatively small subspace of a larger refrigeration space; and
c. allows a refrigeration device manufacturer greater flexibility in manufacturing and marketing refrigeration appliances of different capabilities and features.

In one aspect of the invention, a temperature control assembly for a refrigeration appliance comprises a receiver in a surface of the appliance. A module complementarily fits within the receiver. The module can be either a manual control assembly or an electronic control assembly.

In another aspect of the invention, a refrigeration appliance includes an enclosed space inside it cabinet. A surface associated with the enclosed space is adapted to include a standardized receiver. Different modules can be installed in the same standardized receiver. One module includes a manually translatable member. The manually translatable member has a mechanical output related to user movement of the member. The mechanical output can be used to control amount of cold air flow into the enclosed space to regulate temperature of the enclosed space. Another module includes an electronic user interface which translates a user's touch into an electronic signal which operates an actuator to control amount of cold air into the enclosed space to regulate temperature of the enclosed space.

These and other objects, features, aspects, or advantages of the present invention will become more apparent with reference to the accompanying Specification and claims.

DETAILED DESCRIPTION OF EXEMPLARY EMBODIMENTS

Overview

Figure 1:
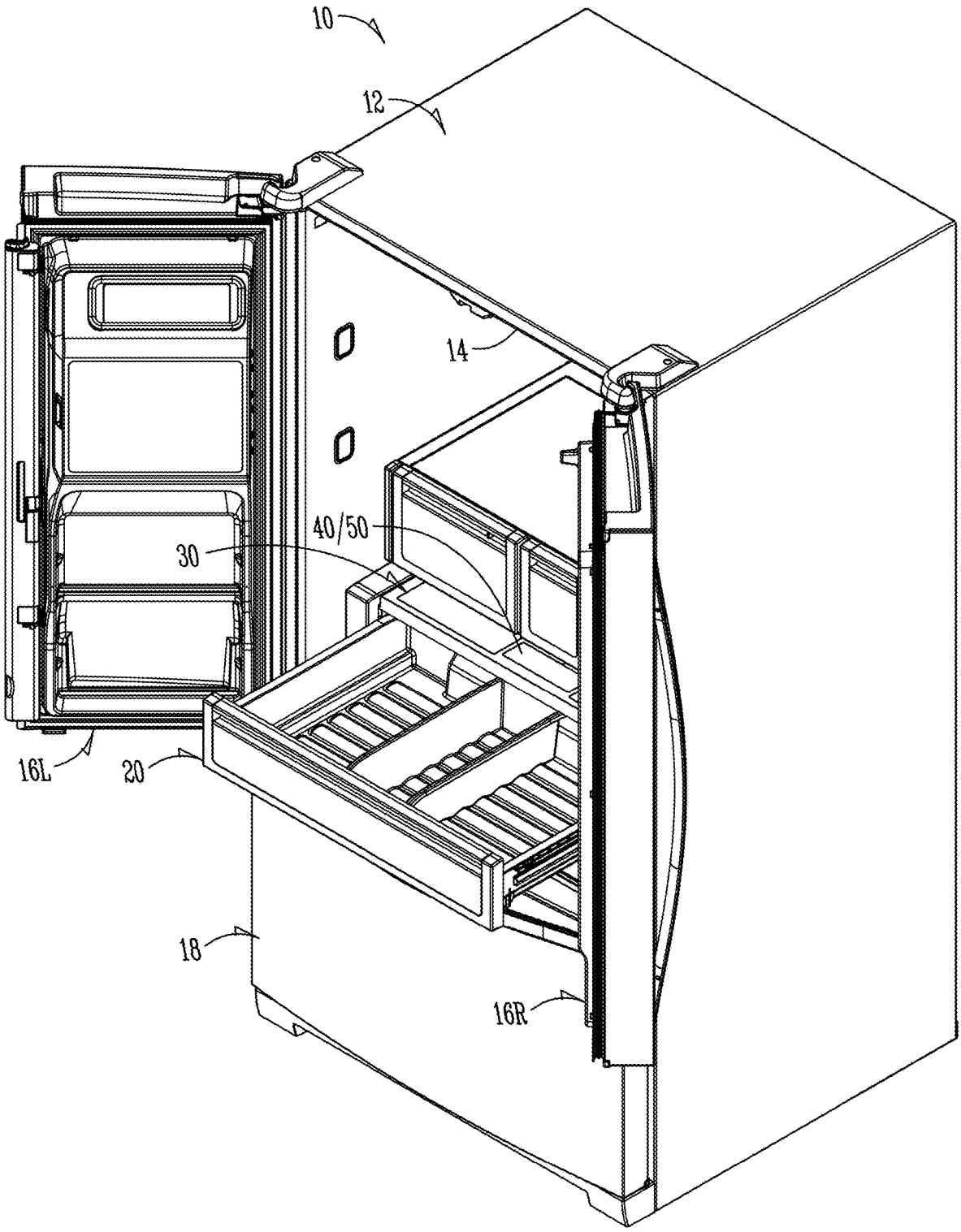
FIG. 1 is a front perspective illustration of a French door, bottom freezer type refrigeration appliance with an independently controlled pantry drawer temperature control system according to one exemplary embodiment of the present invention.

For a better understanding of the invention, exemplary embodiments of several forms the invention can take will now be described in detail. It is to be understood that these embodiments are neither exclusive nor inclusive of all forms the invention can take. For example, variations obvious to those skilled in this technical field will be included within the invention.

This description of examples will be with frequent reference to the accompanying drawings. Reference numerals and letters will be used to indicate certain parts and locations in the drawings. The same reference numerals/letters will be used to indicate the same or similar parts or locations throughout the drawings unless otherwise indicated.

General Interchangeable Module Concept

FIG. 1 illustrates a French door top refrigerator with bottom freezer 10, such as are commercially available. Overall appliance cabinet 12 defines a larger upper cold food space 14. Access to space 14 is by opening one or both oppositely swingable doors 16L and 16R (commonly referred to as "French doors").

A separate insulated enclosed space underneath space 14 is dedicated to a different temperature (e.g., for frozen foods). This is illustrated by drawer 18.

As is typical with modern refrigeration appliances, FIG. 1 shows a variety of different drawers, shelves, and holders in the cold food space 14. In this specific embodiment, a specialized drawer 20 extends the full width and depth of cold food space 14 (unlike many drawers that only extend a portion of the width). However, many of these "pantry drawers" have a relatively small height (e.g., on the order of 3") yet extend the full with of the interior cabinet space. One suggested purpose is for keeping fresh such things as appetizers, deli trays, or items that are already opened (e.g., butter, small packs of condiments, meats, cheeses, or the like). Not only can it be an effective organizational feature, as the name "pantry" implies, it can be beneficial or desirable that the temperature in that pantry drawer be different than the cold food space 14. In some examples, that temperature range might be on a higher end of or exceed the normal range of the cold food compartment 14. In this example, the range could be 32 to 39° F. However, it can be different than this range. If the user desired, it possibly could even be colder than the remainder of compartment 14.

Thus, as indicated, there can be a reason for having an enclosed or substantially enclosed space inside of the greater cold food compartment space 14 that is maintained at a different temperature. In FIG. 1, a top cover plate 30, over a portion of the front of pantry drawer 20, extends substantially across the width of space 14. Included in that cover 30 is either a module 40 or a module 50 that allows user-selectable temperature control for pantry drawer 20.

Module 40 allows manual control in the sense the user grabs and moves a control knob or the like—in one direction to lower pantry drawer temperature and in the other direction to raise it.

Module 50, on the other hand, is an electrical or electronic control. The user still manually selects increase or decrease in temperature by touching, pushing, or selecting with the user's hand or finger. However, that manual selection is translated to an electrical signal that ultimately is used to instruct an electromechanical actuator or other component to adjust the temperature in the pantry drawer.

As can be seen by the Figures, the basic pantry drawer assembly in refrigerator 10 has many similar components for either manual pantry drawer temperature control or electronic control. The same pantry cover 30 can be used for either manual module 40 or the electronic module 50. Although there is a mechanical linkage between manual control module 40 and the center rear of the pantry drawer to control amount of blockage of a cold air pathway into the pantry drawer; and there is a wiring harness from electronic control module 50 to appropriate electronic and electrical components to control amount of blockage of the cold air pathway to a different part of the pantry door, in both cases the same pantry drawer cover assembly, with the same module receiver, can be used for either module 40 or 50. While there are different configurations as to such things as where the cold air enters the pantry drawer chamber and what component or components block or unblock the cold air path, the standardized pantry drawer cover and receiver provides a number of benefits. It promotes economy in the parts and assembly of parts for either manual or electronic pantry drawer temperature control. This can make production of different models of refrigeration appliances more economical and efficient.

Thus, as illustrated generally in FIG. 1, a user-adjustable temperature module for pantry drawer 20 is presented conveniently to the user. That same format allows either inclusion of a first module for manual and mechanical control temperature or an alternative module for electronic/electrical/mechanical control. The manufacturer or customer simply selects which option. The same basic supporting structure and location of either module makes such manufacturing and assembly simpler and more efficient.

Figure 2A:
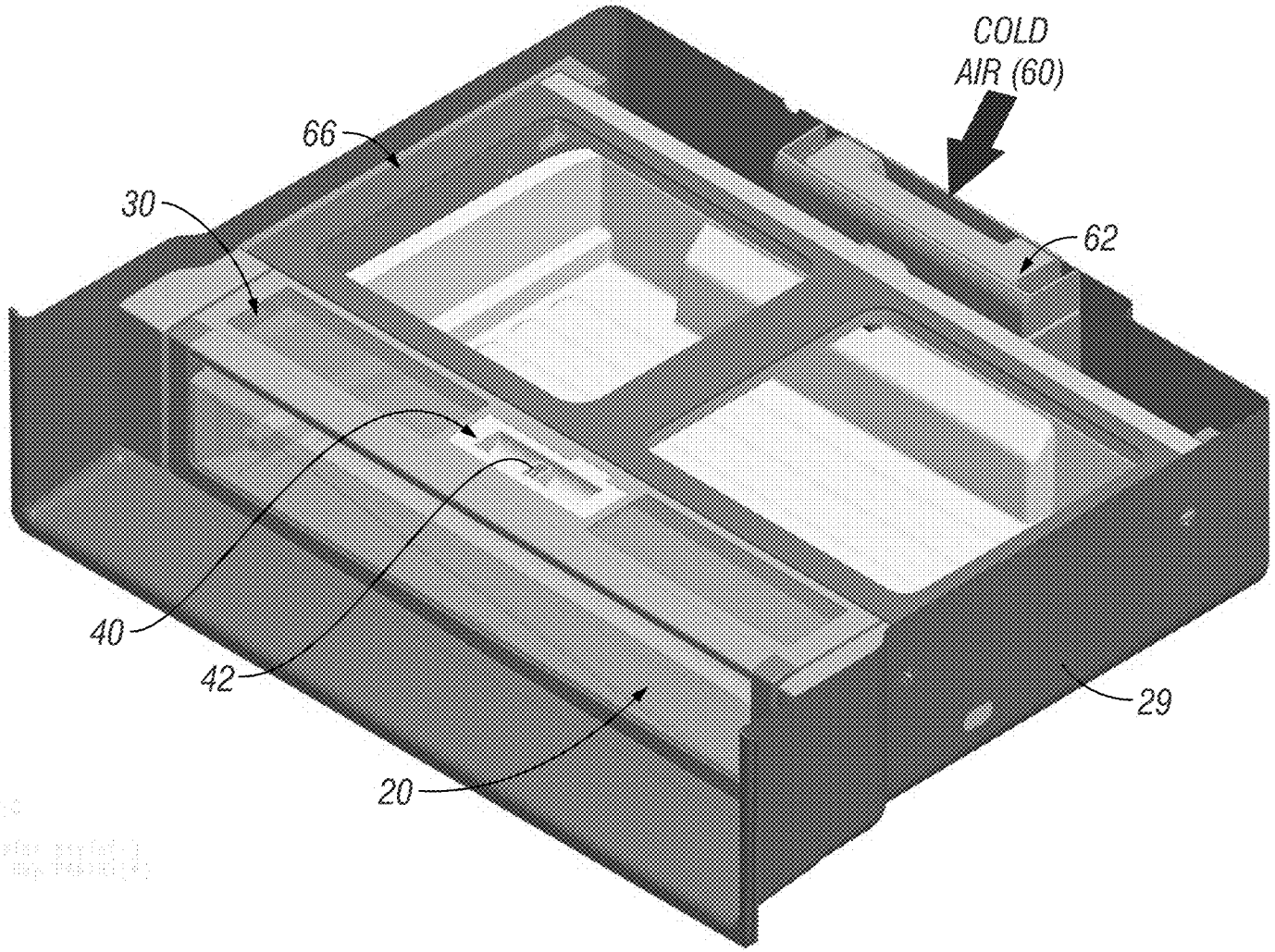
FIG. 2A is an enlarged perspective partial sectional view of pantry drawer of FIG. 1 in a closed position.
Figure 2B:
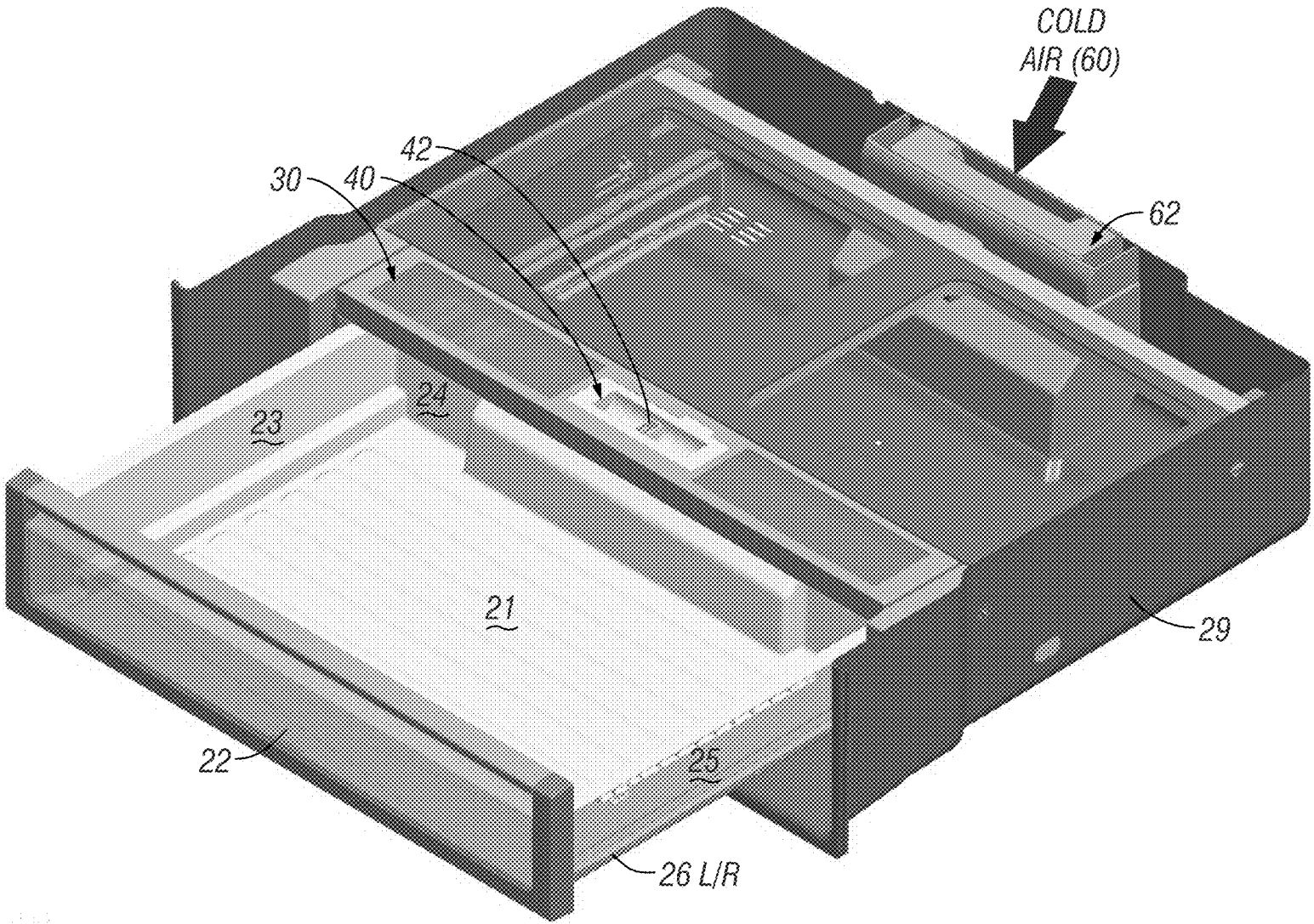
FIG. 2B is similar to FIG. 2A except showing the pantry drawer pulled out.

FIGS. 2A and 2B provides details of one example of a pantry drawer 20. A generally horizontal floor 21 is surrounded by a taller front wall 22, and shorter left side, back, and right side walls 23, 24, 25. Drawer 20 has rails 26L and 26R on opposite side walls 23, 25, which complementarily work with roller runners 28L and 28R attached on side plates 27L and 27R (See FIGS. 4A-B or FIGS. 9A-B) mounted to an H-shaped pantry assembly support 66 attached to opposite interior walls of cooling compartment 14 so that drawer 20 can slide outwardly for user access to floor 21.

Figure 3:
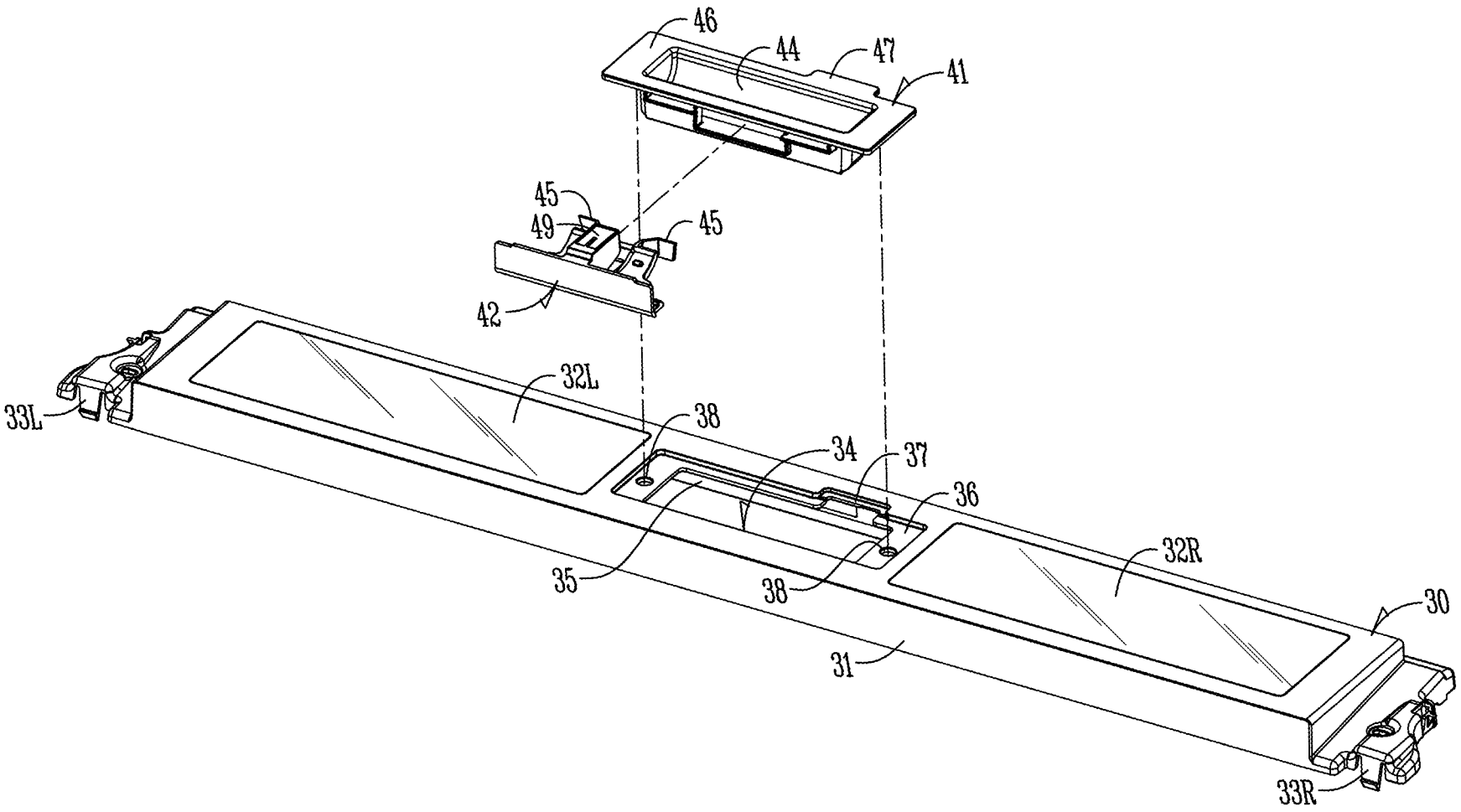
FIG. 3 is a still further enlarged isolated exploded view of the pantry drawer top cover 30 of FIG. 1 showing a manual temperature control slide control module 40 that can be assembled to pantry drawer cover 30.

But as seen in FIG. 3, pantry drawer cover 30 includes a frame 31 around its perimeter, a receiver opening 34 (for receiving either temperature module 40 of FIG. 3 or temperature module 50 of FIG. 8A), and in this example, two transparent windows 32L and 32R on opposite sides of module 40 or 50 (to allow user view of the contents of drawer 20 when pushed back into space 14).

Figure 9A:
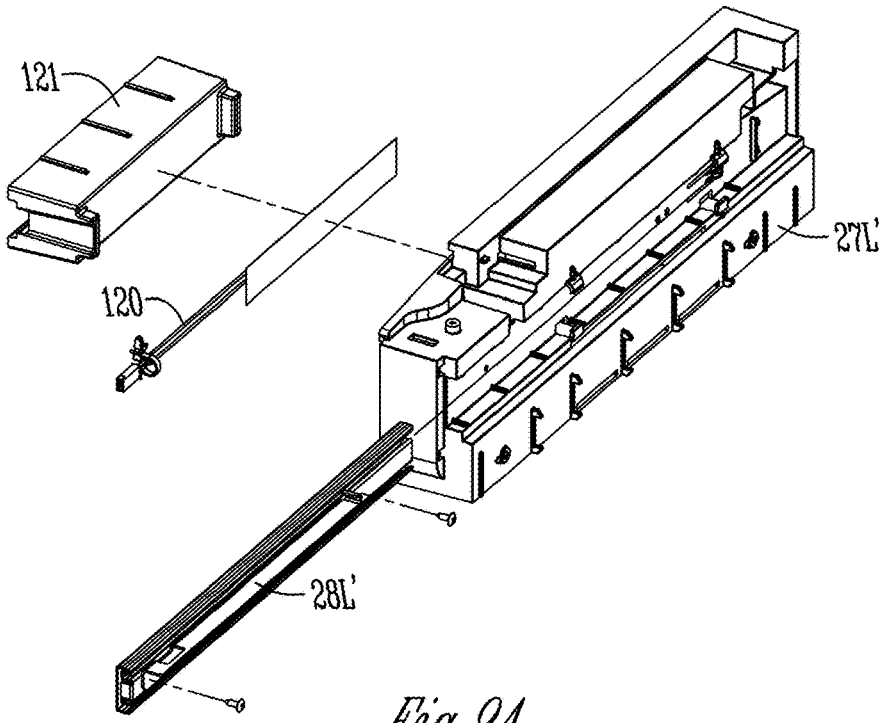
FIGS. 9A and 9B show side plates, rails, and an optional heater feature for supporting pantry drawer 20 in combination with electronic module 50 of FIG. 8A.
Figure 9B:
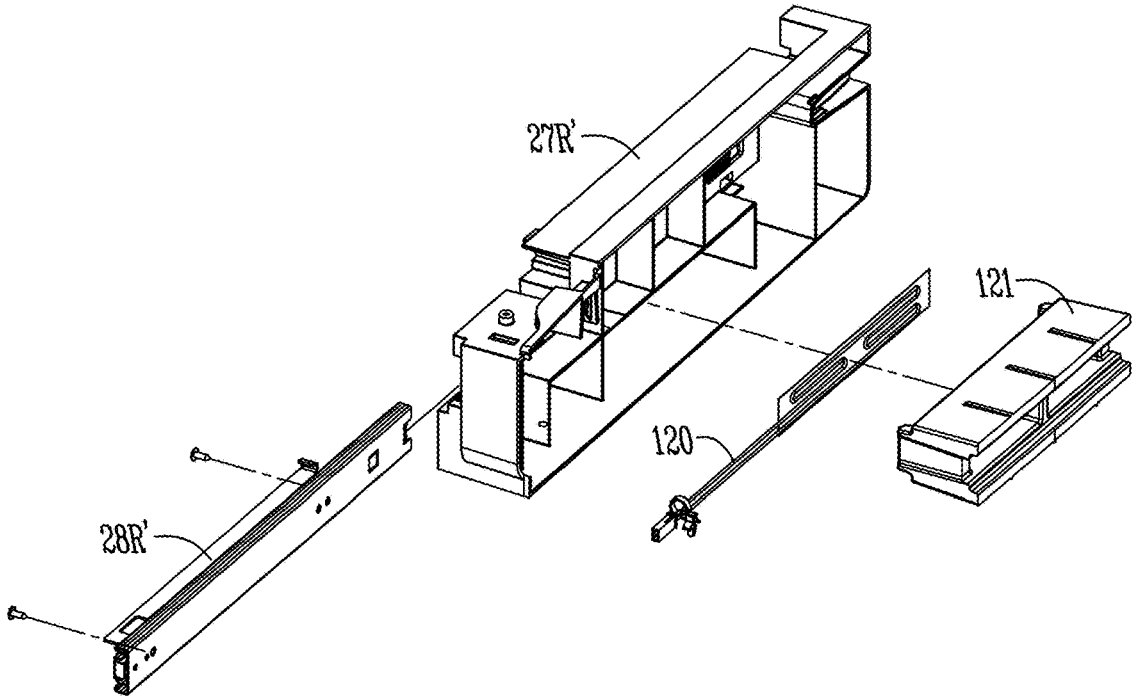

The modular design of cover 30 and options 40 or 50 are shown in more detail in the remaining Figures. In both cases (module 40 or module 50), the same pantry drawer cover 30 is utilized. Connection members 33L and 33R at opposite ends of frame 31 allow the connection of cover 30 to side plates 27L and 27R for module 40 (FIGS. 4A and 4B) or 27L' and 27R' for module 50 (FIGS. 9A and 9B). Windows 32L and 32R are installed in complementary openings by known methodologies.

The opening, here called receiver 34, is shown in FIG. 3. In this example, the perimeter 35 of receiver 34 is bordered by a shoulder 36, which is countersunk from the top level of frame 31. A small asymmetric enlargement 37 of the receiver opening exists around the perimeter of that shoulder. Through holes 38 allow posts or screws to pass to fasten a module 40 or 50 into receiver 34.

Importantly, cover 30 is identical for either module 40 or module 50. As can be seen in FIG. 3, either module fits and can be secured in receiver 34.

Specific Manual Pantry Drawer Temperature Module

With particular reference to FIGS. 2A-B to 7A-B, one exemplary way to build and use a manual pantry temperature control is illustrated in detail. It is to be understood that this embodiment utilizes the general concept of the same pantry drawer cover 30 as the electronic version but drops into receiver 34 of cover 30.

Manual module has a basic body or frame 41. A slideable sub-component 42, with finger-controlled manual slide knob 49, snaps into body 41. Body 41 is basically snapped into receiver 34.

Figure 5:
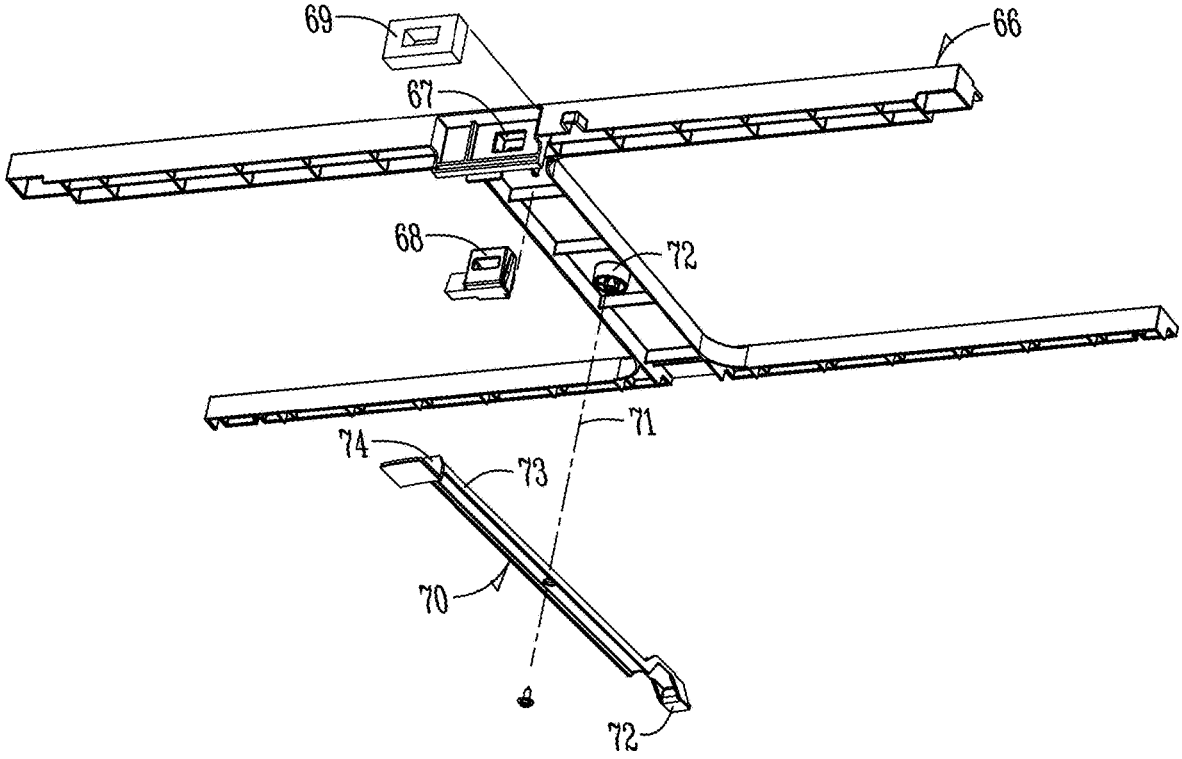
FIG. 5 is an isolated exploded bottom and rear perspective view of a pantry support assembly 66 of FIG. 2A illustrating in detail a pivotable control arm to communicate manual sliding action of manual control module 40 to open, close or adjust the opening cross-sectional area of the cold area inlet that adjust temperature in and around the pantry drawer.

As shown in FIG. 5, a linkage or control arm 70 is pivotally attached at pivot axis 71 to the underside of H-shape support frame 66. Its proximal end 72 (proximal to control module 40 when it is installed) fits between rearward extending spaced-apart fingers 45 on slide 42. The opposite or distal end 73 of arm 70 has a small plate 74.

When assembled, lateral sliding of slide 42 in either direction by moving manual control knob 49 results in manual control of the size of the opening of a cold air inlet or pathway to the rear of the pantry drawer space, which controls pantry temperature. It is to be understood that in this embodiment, by means well-known in the art, cold air flow can be directed through an opening the rear of the pantry drawer 20 into the pantry drawer space. The flow of air can be controlled through that space to have fairly precise control of temperature in that space. In this example, the opening from the cold air source (cold air shown generally by reference number 60) is basically centered at the back of pantry drawer 20 to allow for fairly direct control of a member from slide 42 at the front top cover 30 of the pantry drawer assembly.

Specifically regarding the manual option, module 40 includes a body 41 having a top plate with a perimeter that includes a tab 47 whose shape is complementary to matingly fit on top of shoulder 36 of receiver 34. Module body 41 has a substantially open interior 44 with an opening in one sidewall (see reference numeral 43). Slide 42 fits in opening 43 and is captured in open area 44. The combination of frame 41 with assembled slide 42 seats into receiver 34 of pantry drawer door 32 and can be guided into place by downward extending posts on slide 42 that fit into holes 38. Alternatively other fastening methods might be used. In this way, module 40 can fit flush into cover 30 but present to a user basically a sunken knob 49 that can be grasped with the user's fingers and slid left or right. Thus, manual sliding action is available to translate mechanically to change temperature in pantry drawer 20.

As shown at FIG. 3, knob 49 slides in the space 44 of module housing 41. The small, spaced-apart fingers 45 (basically opposing L-shaped flanges) are positioned on the inboard side of housing 41. Housing 41 basically snaps into top cover 30 using pegs or posts 48 into apertures 38. Asymmetric features like 47 in module 40 would fit within complimentary feature 37 of cover 30 to allow easy centering and consistent positioning of module 40 in cover 30.

Figure 4A:
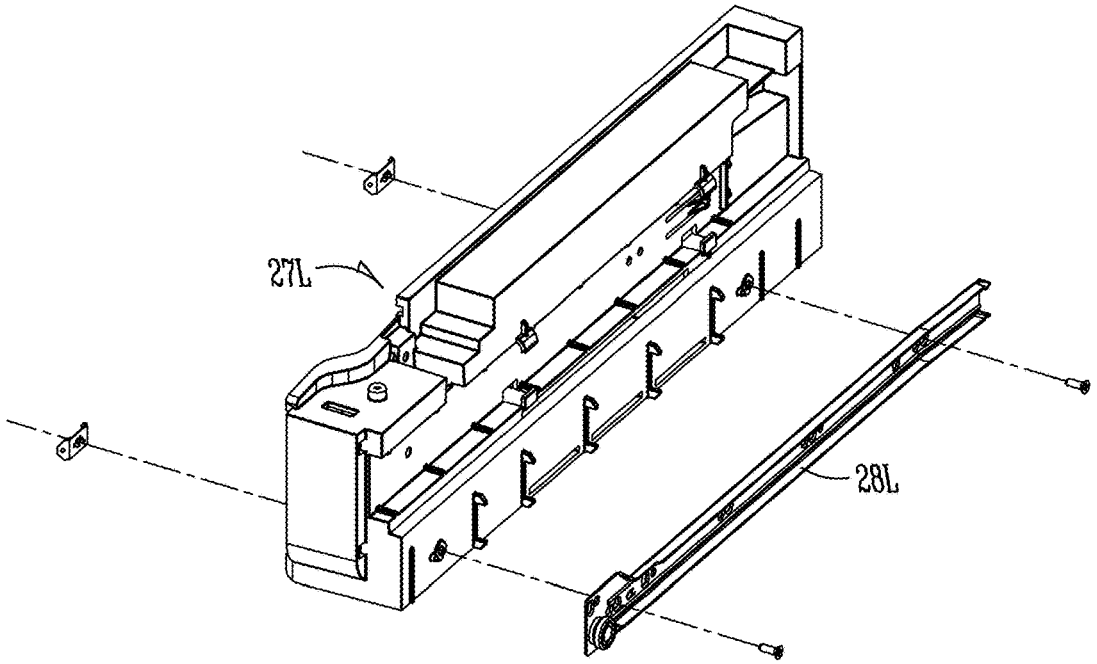
FIGS. 4A and 4B are isolated exploded perspective views of side plates that can be used to support pantry drawer 20, and manual module 40 and cover 30 of FIGS. 2A-B and 3 in a refrigeration appliance.
Figure 4B:
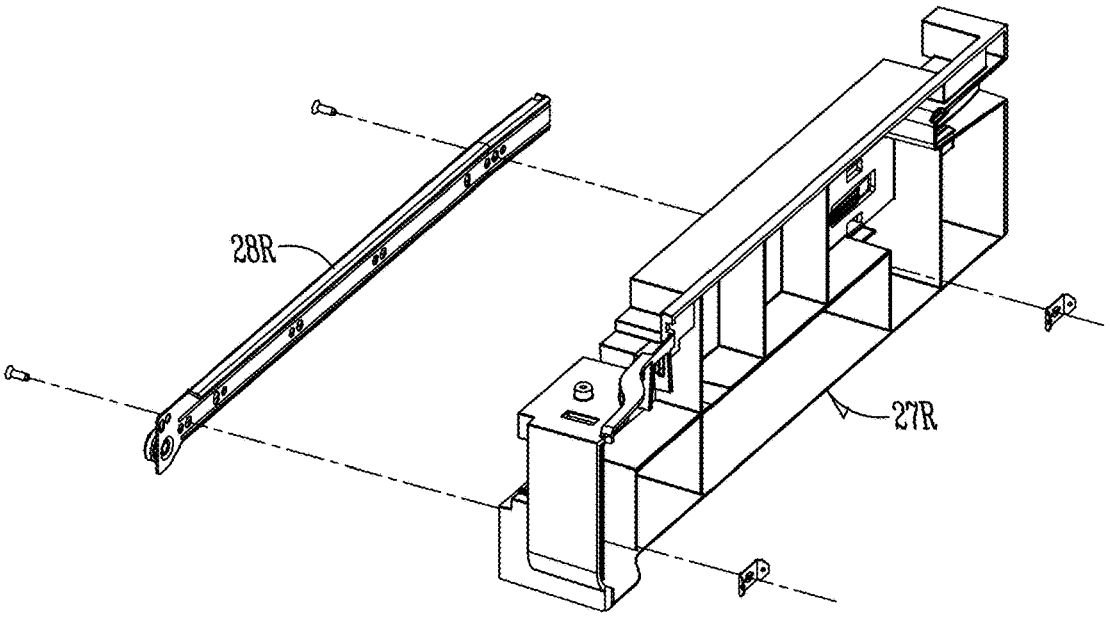

FIGS. 4A and 4B illustrate left and right side plates 27L and R which support roller runners 28L and R which would, in turn, receive and allow for efficient opening and closing of pantry drawer 20. FIGS. 4A and B also show the side plates can be specifically adopted for supporting the cover 30 across the front and top of those side plates.

Referring to FIG. 5, H-shaped pantry support assembly 66 also assembles to the top of side plates 27L and R. A glass plate can be supported on top of pantry support assembly 66 (see FIG. 11B). Note the following features of H-shaped assembly 66.

H-shaped member 66 is specifically adapted for manual control module 40. Along the center member is a receiver 72 to which control arm 70 can be pivotally attached. Also, note how at the center of the rear lateral cross arm of component 66 is an opening 67 that would align with and a cold air opening at the center back of the refrigerator 10. A gasket 69 can be fitted around one side of opening 67. Another gasket-type member 68 can be fitted on the opposite side.

When assembled, components 66 would allow the back end 74 of control rod 70 to either completely block the pathway through gasket 69, opening 67, and gasket 68, or pivot over a range from just slightly uncovering that pathway to fully uncovering that pathway. The opposite or front end 72 of control arm 70 would fit in the space between spaced apart ears 45 of slide member 42 at module 40. Lateral sliding of control knob 49 in either direction would cause commensurate pivoting of control rod 70 around pivot axis 71. By appropriate coordination of the amount of allowable lateral sliding of control element 42 and the size of back plate 74 of control arm 70 relative to the cross-sectional area of the cold air pathway to pieces 67, 68 and 69, a manual control of cross-sectional area of a cold air flow path in the pantry drawer 20 can be obtained.

Figure 6A:
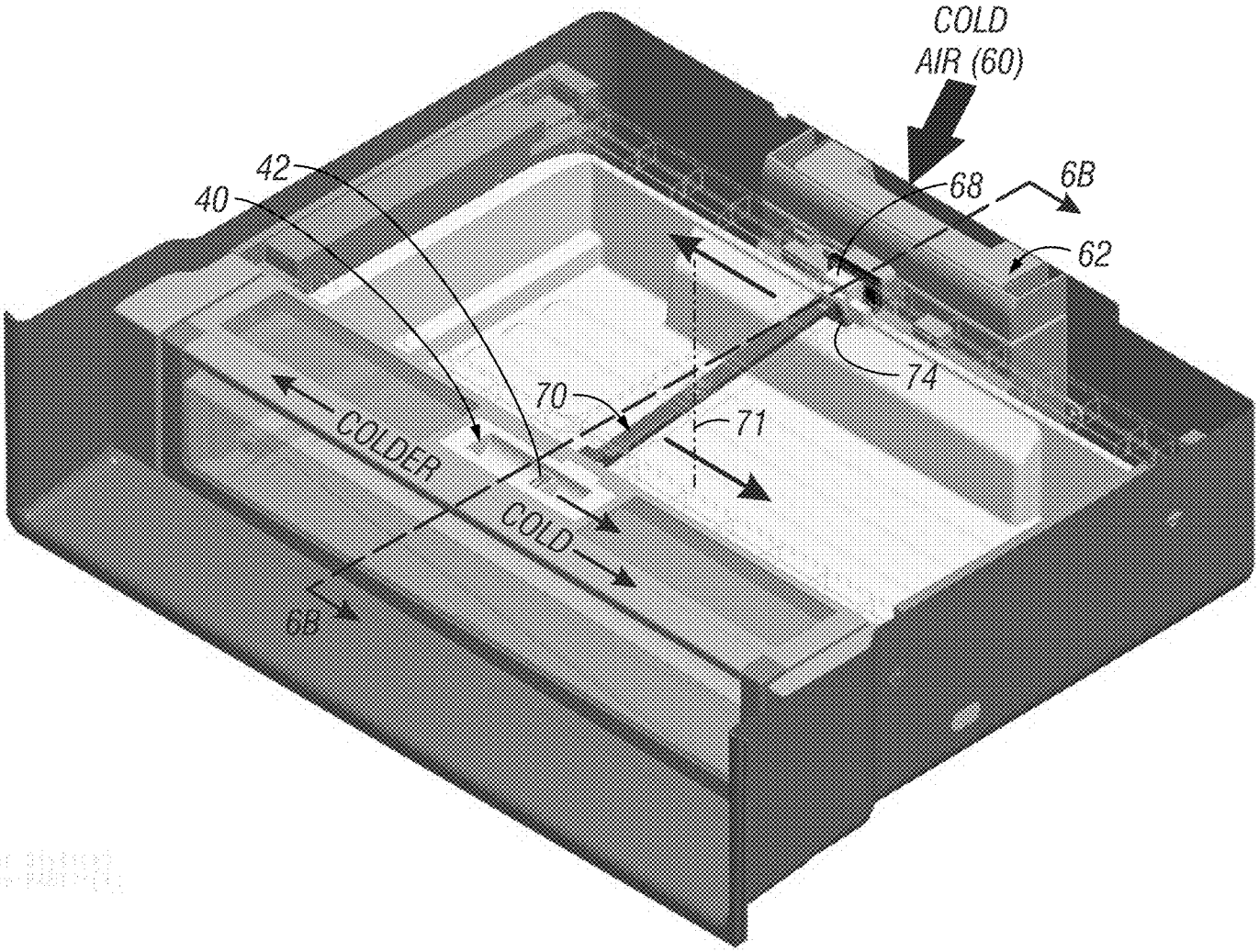
FIG. 6A is similar to FIG. 2A but with pantry support assembly 66 removed to illustrate how the pivotable control rod 70 can cover a cold air pathway into the pantry drawer in response to sliding of the manual slide knob to one extreme position to promote pantry drawer temperature at the upper end of a range of pantry drawer temperatures.
Figure 6B:
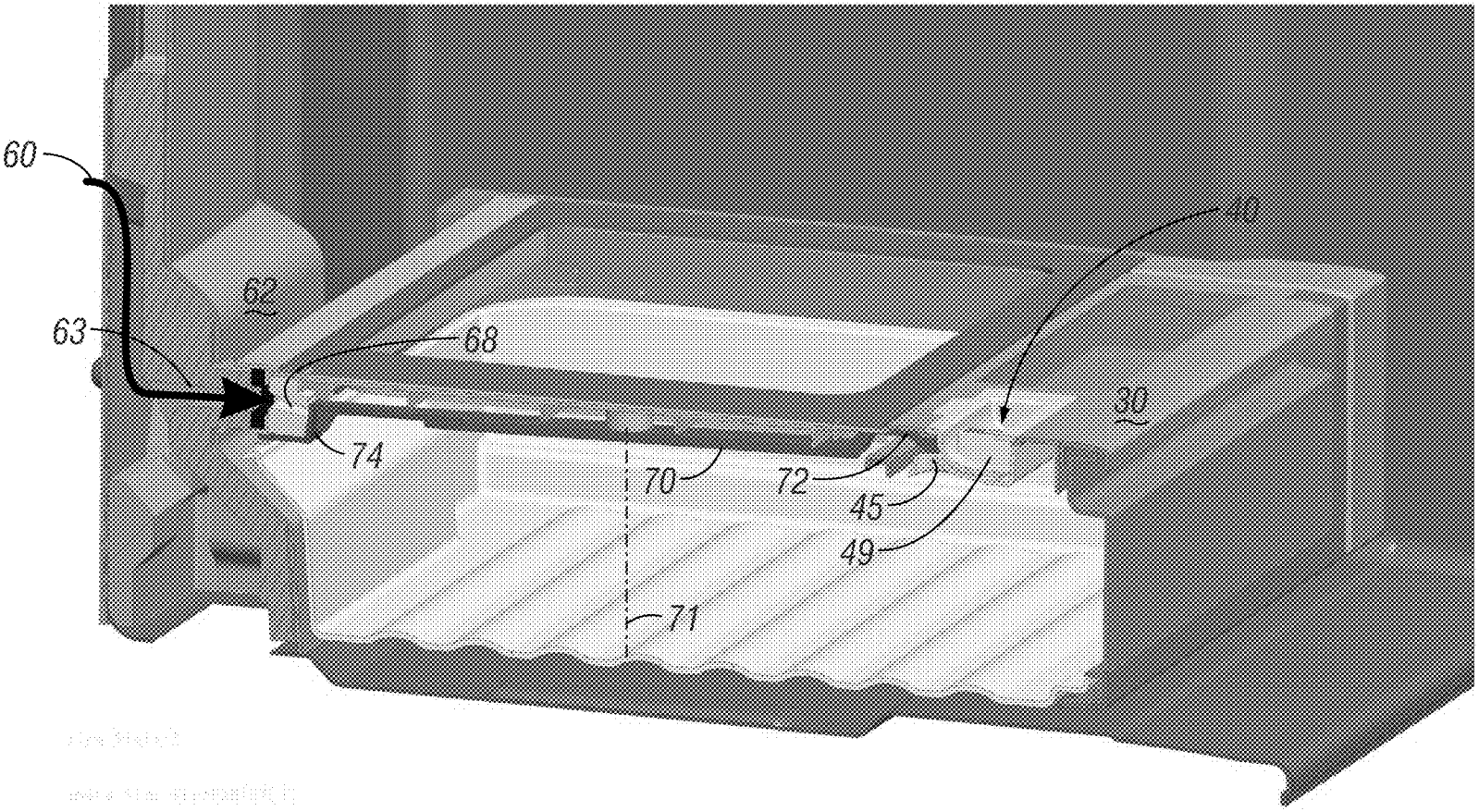
FIG. 6B is a sectional view of FIG. 6A generally along lines 6B-6B but with pantry support assembly 66 in position, showing in greater detail the blocking of the cold air pathway into the pantry drawer by the distal end of control arm 70.

FIGS. 6A and 6B illustrate slide control 42 in what will be called a "cold" position to the right of the space 44 in manual control module 40. In that position, control arm 70 is basically straight back to opening 67. Plate 74 on the rear end of control arm 70 can basically completely cover (or at least substantially cover) the cold air path. FIG. 6B illustrates that covering and how the front end 72 of control arm 70 sits in gap between ears 45 of control element 42. Thus, a physical connection between control arm 70 and slide 42 is not required. Slide 42 pushes the proximal end 72 of control arm 70 in either direction because end 72 is captured between ears 45

Figure 7A:
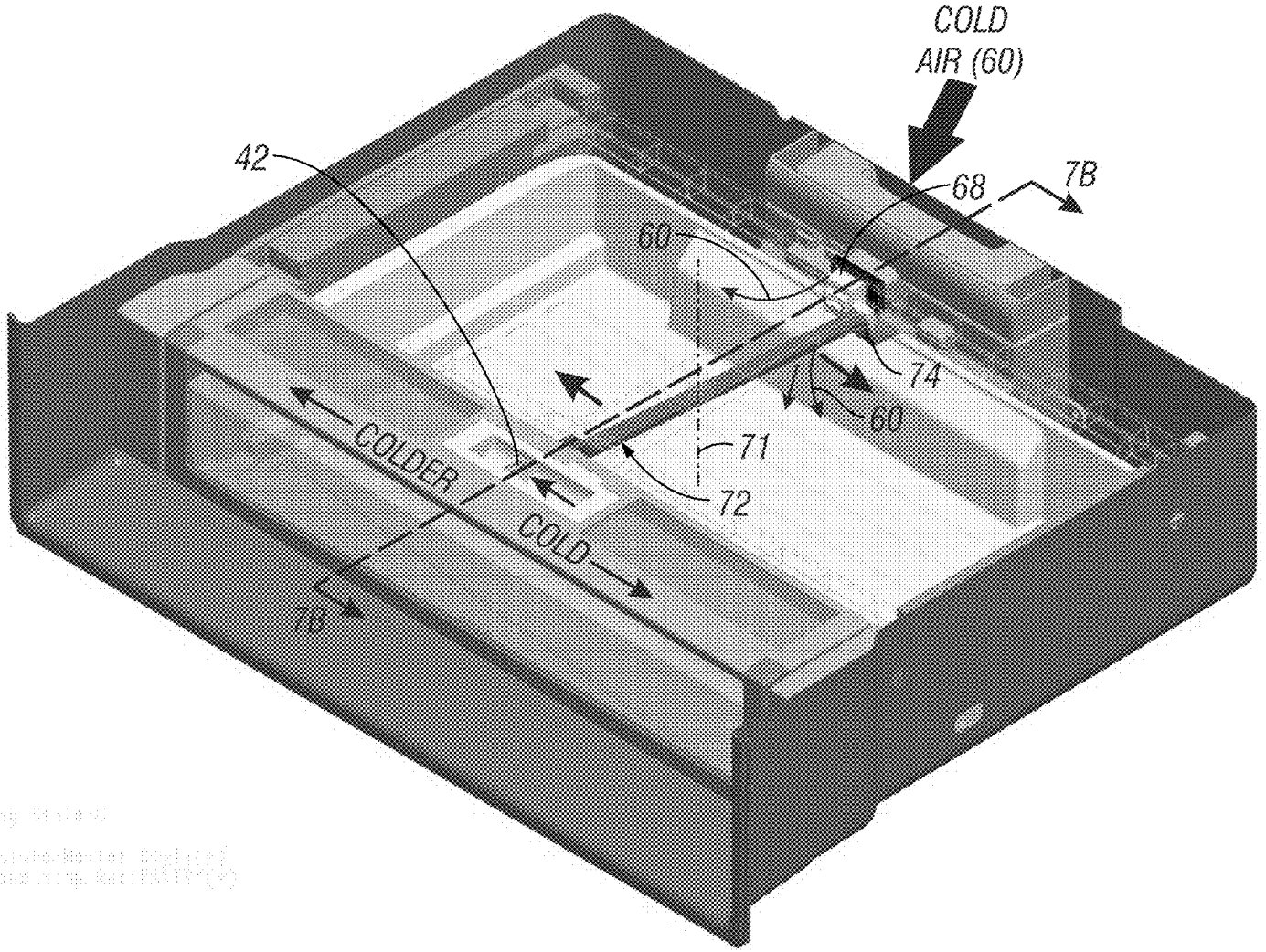
FIG. 7A is similar to FIG. 6A but shows the manual slide control moved towards an opposite extreme position, which pivots control arm 70 so that its distal end uncovers at least a substantial part of the cold air pathway into the pantry drawer to promote colder temperatures in the pantry drawer.
Figure 7B:
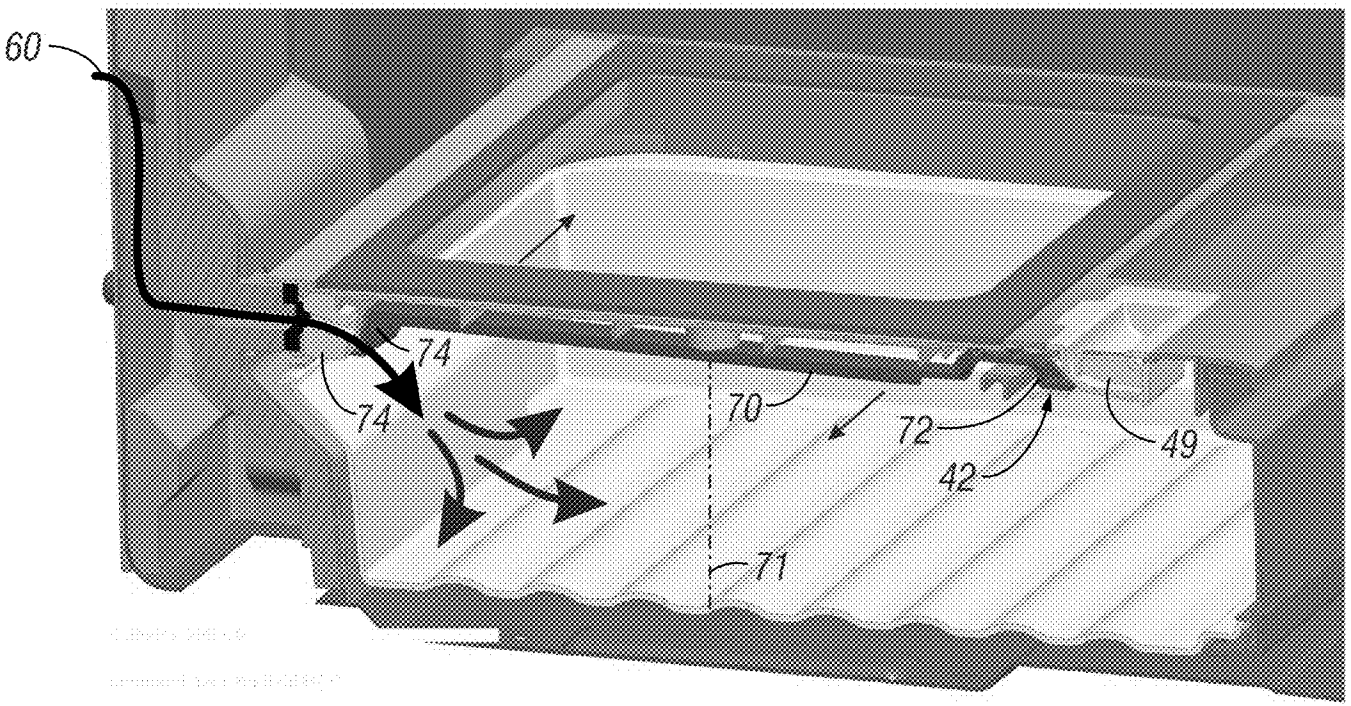
FIG. 7B is similar to FIG. 6B but taken along lines 7B-7B of FIG. 7A, and shows in more detail the unblocking of the cold air pathway into the pantry drawer.

In comparison, FIGS. 7A and 7B show control element 42 slid laterally to the left. This causes a commensurate pivoting of control arm 70 around pivot axis 71 such that plate 74 uncovers at least some of the cold air path in the pantry drawer 20. In this position, called "colder" the greater cross-sectional area for the cold area flow path is exposed to the interior of pantry drawer 20 promoting colder pantry drawer temperatures.

As can be appreciated, by methods well-known to those in the art, the range of temperature control of pantry drawer 20 can vary according to need or desire. In this example, the range has been set to approximately 32 to 39° F. (32° being the approximate lower end of the "colder" temperatures; 39° being the approximate upper end of the "cold" temperatures). This range can be made larger or smaller, if desired, or a different range. This can be accomplished in a number of ways. Once would be to increase the size of the old air opening at the rear to the pantry drawer (allowing the possibility of greater throughput of cold air). Another would be changing the temperature of the cold air. Others are possible as is within the skill of those skilled in the art. These methods can be combined.

While the temperatures may not precisely stay within a given range, by appropriate calibrations and control, they can be at least approximately matched. At a minimum, such a manual pantry drawer temperature control would allow some adjustment of pantry drawer temperature according to where the manual control 42 is moved. As can be appreciated, the connection of control arm 70 to the bottom of H-frame pantry support 66 would allow pivoting of the arm around pivot axis 71, and the assembly of slide 42 into housing 41 would allow manual sliding across the given distance that is allowed by those components.

This manual module 40 therefore allows economical and direct manual control of the size of the cold air pathway into the pantry drawer 20 with little, if any, interference with the space and operation of pantry drawer 20. Assembly steps are straight forward and non-complex. Material costs are minimal Even though side plate 27, H-shaped support 66 and control module 40 are unique for manual control, these pieces are primarily made with economical materials and methods (e.g. plastic). And, as will be seen, the differences of these types of parts for both manual and electronic control are similar. And they can be efficiently and economically implemented in the same general configuration so that the basic structure and arrangement of the refrigeration appliance does not have to be substantially different or substantially changed. The pantry top cover 30 is the same for both manual and electronic control. Its placement is the same. As can be appreciated, this allows efficient and economical assembly of different models of refrigeration appliances with either manual control or electronic control.

As is illustrated in FIGS. 2A through 7B, manual pantry temperature control is non-complex and direct at the front top of pantry drawer 20. Cold air 60 is available at the rear of pantry drawer 20. Manual movement of slide 42 to "cold" blocks cold air flow 60 from entering into pantry drawer 20 (FIGS. 6A and B). Manual sliding of slide 42 to the opposite extreme unblocks the cold air pathway into pantry drawer 20, promoting colder pantry drawer temperatures. Moving slide 42 to positions in between opposite extremes blocks various percentages of the cross-sectional area of the cold air pathway and, thus, promotes a proportional pantry drawer temperature within the range between fully open and fully closed.

Specific Electronic Module Embodiment

By specific reference to FIGS. 8A-B through 19A-C, electronic pantry temperature control module 50 will be described in more detail.

Figure 8A:
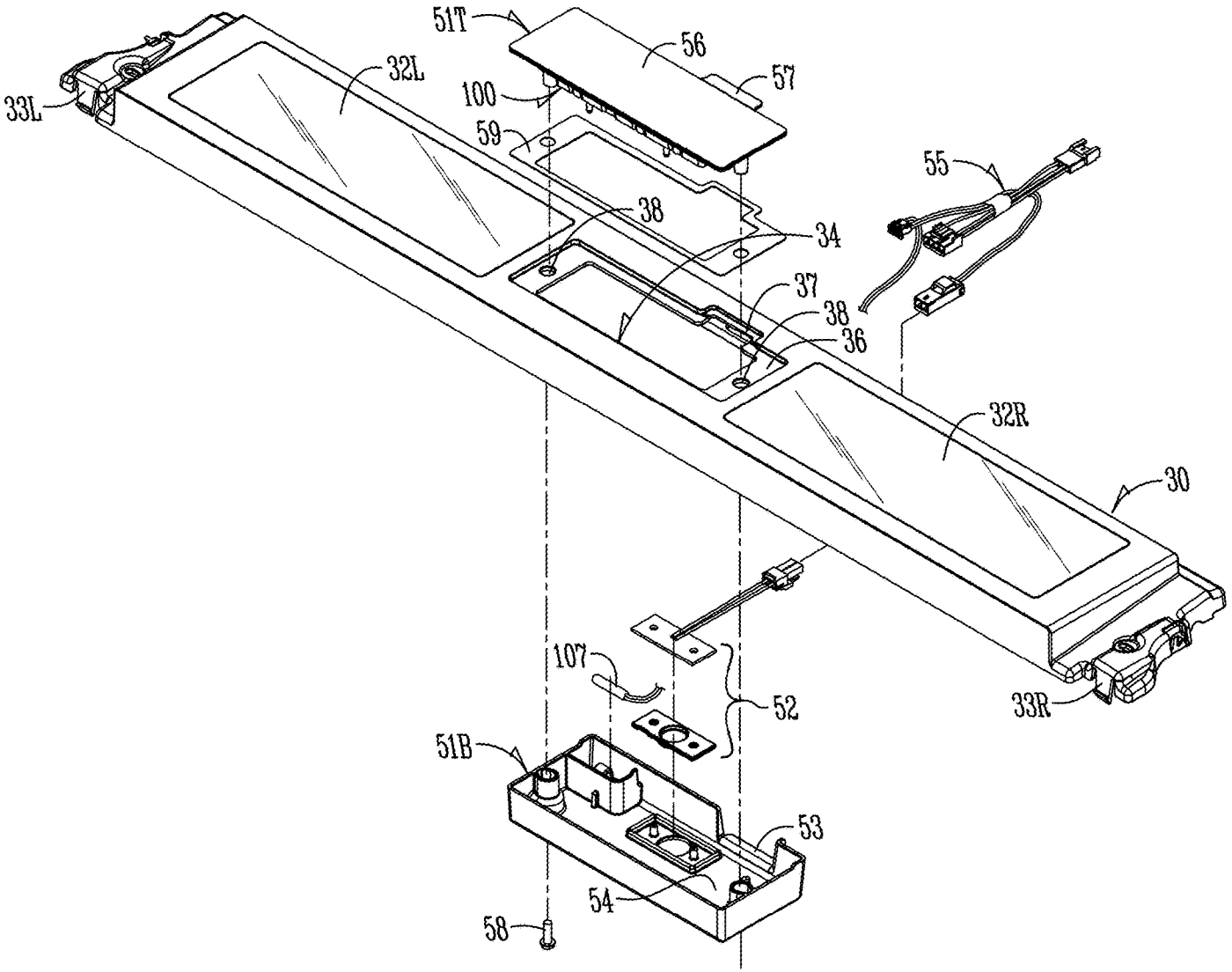
FIG. 8A is similar to FIG. 3 but shows an electronic pantry drawer temperature control module 50 in exploded fashion relative to the same pantry cover 30 of FIG. 3.

In comparison to the manual mobile 40 of FIG. 3, FIG. 8A illustrates how alternative electronic module 50 fits in the same receiver 34 in the same pantry drawer top cover 30 as with the manual version. Module 50 includes a top section 56 with outward jutting tab 57 that fits in a complementary fashion on top of shoulder 36 of receiver 34. A gasket 59 can be placed between shoulder 36 and top 56. A bottom housing 51B can be assembled to top portion 51T with screws 58 through appropriate apertures in bottom part 51B, through apertures 38 and cover 30, and into receivers in the bottom of top portion 51T, as illustrated in FIG. 8A. This again would present a basically integrated or flush appearing center temperature control on cover 30, but would house components that would allow for a user interface to touch the panel of top part 51T to adjust temperature up or down, and generate an electrical signal in correspondence thereto that can be used to actuate such temperature change.

The figures show how the same pantry drawer top cover 30 can be used to substitute or originally install an electronic/electrical pantry temperature control module 50 instead of a manual control (or even a blank if no temperature control is desired). An electric user interface assembly 100 has a perimeter geometry that includes an asymmetrical portion 57 that would fit in a complimentary fashion into top cover 30, receiver 37 to help position module 50 in cover 30. As will be described later, top fascia overlay 56 can have indicia or icons for the user to touch to manually select pantry drawer temperature. That touch would be converted by assembly 100 into an electrical signal that can be communicated via wire assembly 55 to the appropriate components to adjust a cold air opening accordingly at the rear of the refrigerator 10 and into the pantry drawer 20.

In this embodiment, several features can be included with electronic module 50.

For example, an LED assembly 52 can provide downlight for the front of pantry drawer 20, helping the user see the contents of pantry drawer 20. A thermister 107 inside of cover 51B could monitor pantry drawer 20 temperature and send a signal to, for example, a refrigerator electronic controller (such as are well known in the art), so that there could be automatic refrigeration temperature adjustment techniques to adjust or maintain a pantry drawer temperature. Cover 51B attaches through openings 38 and cover 30 to the fascia overlay 56 and its underlying circuit board 101 (see FIG. 15) to sandwich those pieces, including gasket 59 to cover 30.

Figure 8B:
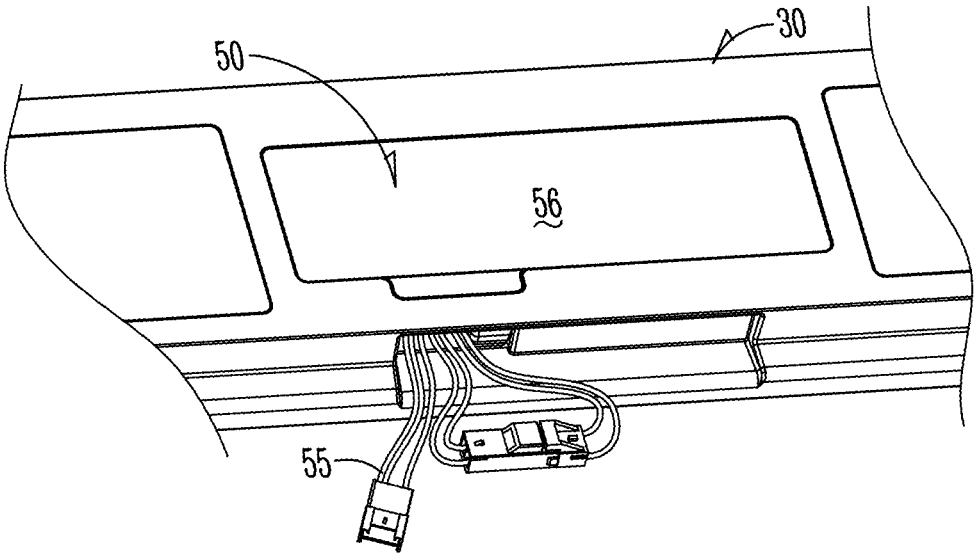
FIG. 8B is an isolated enlarged assembled view of the electronic module 50 assembled into cover 30.

FIG. 8B illustrates how electronic module 50 can be assembled into cover 30 and wiring harness 55 extend out backside opening in cover 30. This wiring can electrically communicate user interface assembly 100 to wherein in refrigeration appliance 10 is needed. The wires can be run under H-shaped support 66' or cover 30 to keep them protected and out of the way.

Similar to the manual control embodiment, left and right side plates 27L' and 27R' would allow cover 30 to be supported as well as pantry drawer 20 roll on plates 27L' and 27R'. FIGS. 9A and 9B illustrate another optional feature. Thin film resistive heaters 65 could be electrically connected to a refrigerator controller or to circuitry in assembly 100 to be selectively operated to help maintain a certain pantry drawer 20 temperature. Operation of such heaters is well-known in the art.

Figure 10:
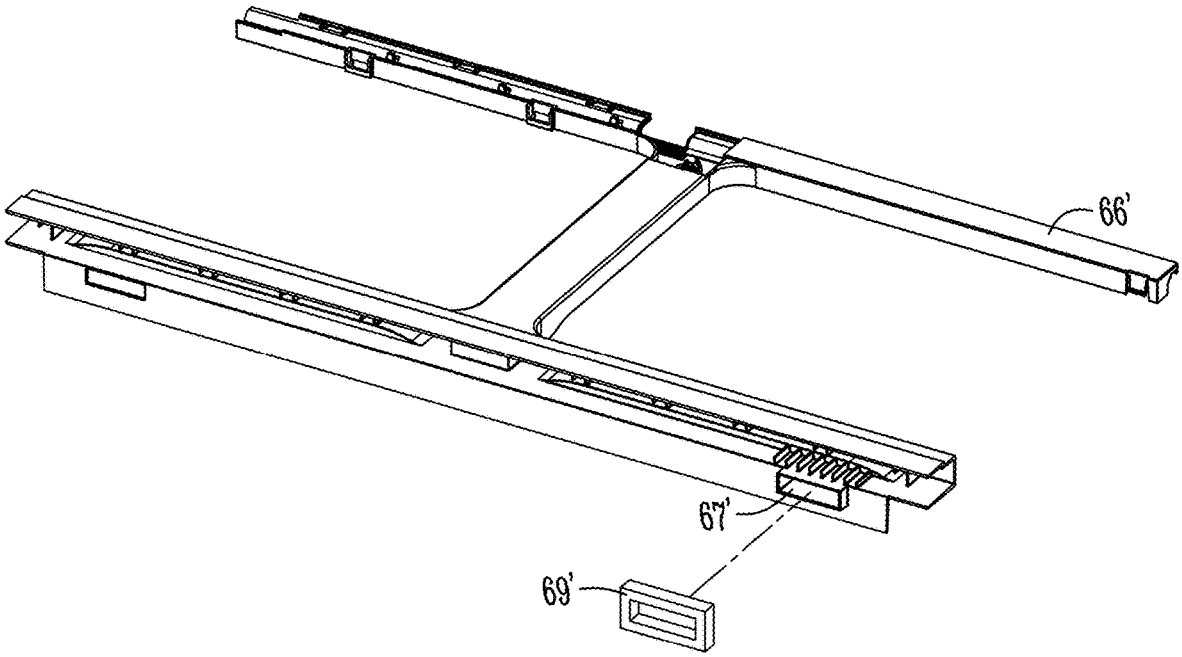
FIG. 10 shows a pantry support assembly 66' for the electronic control of pantry drawer temperature.

FIG. 10 shows alternative H-shaped pantry support 66' (compare support 66 of FIG. 5). As can be seen, this rear view of support 66' illustrates how wiring harness 55 could extend to the rear of the refrigerator 10 on the underside of the middle part of 66'. In this electronic embodiment, cold air inlet 67' is not centered in the back of each component 66' but to the left rear side. Gasket 69' can be positioned around opening 67'. Electronic H-shaped support has such differences from manual model 66, but retains a similar overall shaped. Thus, easy substitution of each member 66' for member 66 sets up the electronic version of pantry drawer 20 temperature control.

Figure 11A:
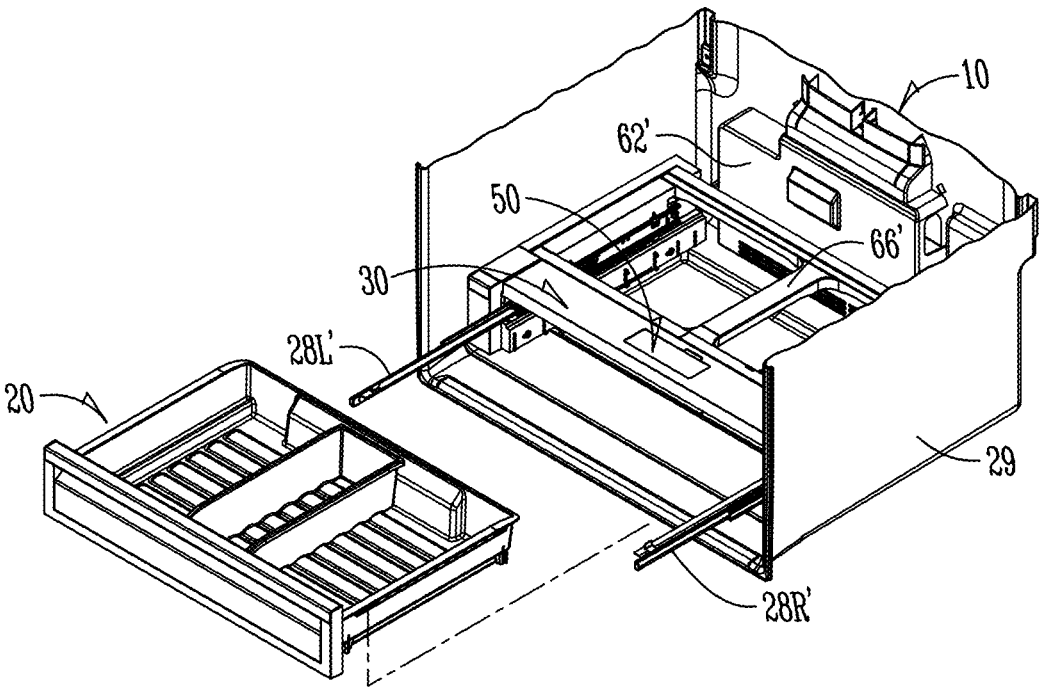
FIG. 11A is a perspective view showing assembly of support components for the electronic version of temperature control for pantry drawer 12 (with parts of the refrigerator liner cut away for clarity).
Figure 11B:
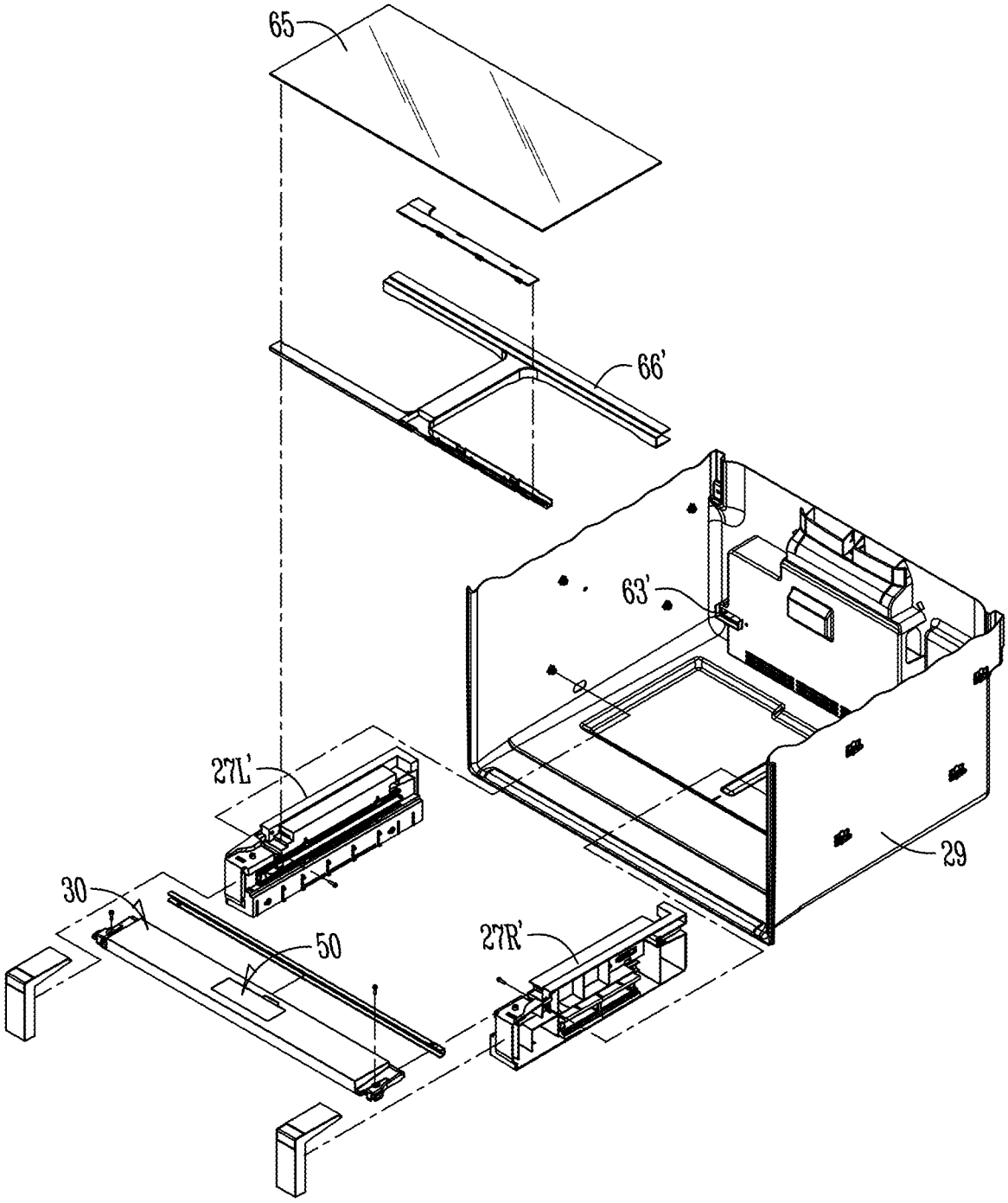
FIG. 11B is an exploded view of FIG. 11A.

FIGS. 11A and B show further details of the electronic version. As shown in FIG. 11B, cold air inlet 63' would be at the back wall of cold air housing 62 in alignment with opening 57' of each member 66'.

Figure 12A:
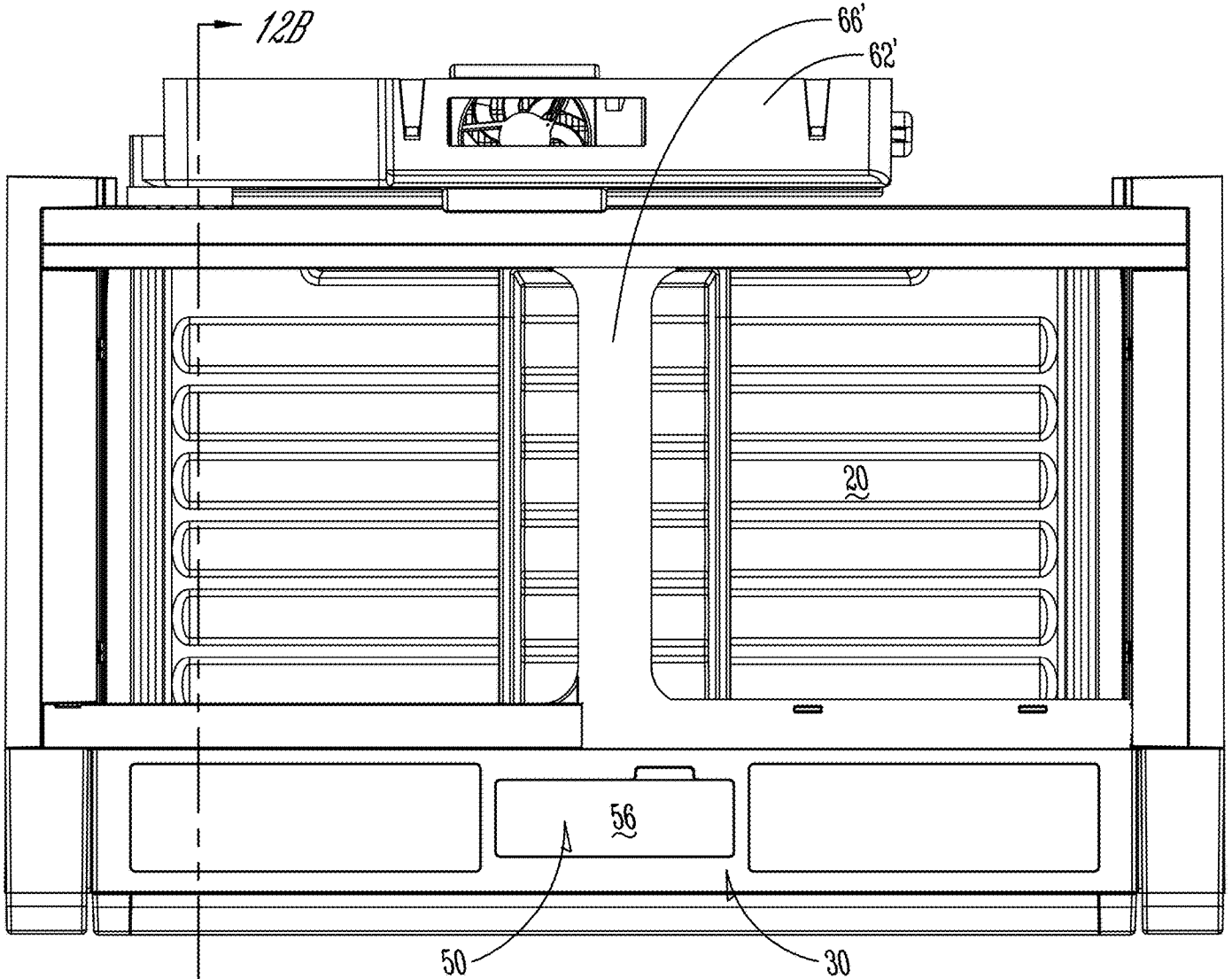
FIG. 12A is a top plan view of the assembled electronic module of FIGS. 11A and 11B with pantry drawer 20 in closed position.
Figure 12B:
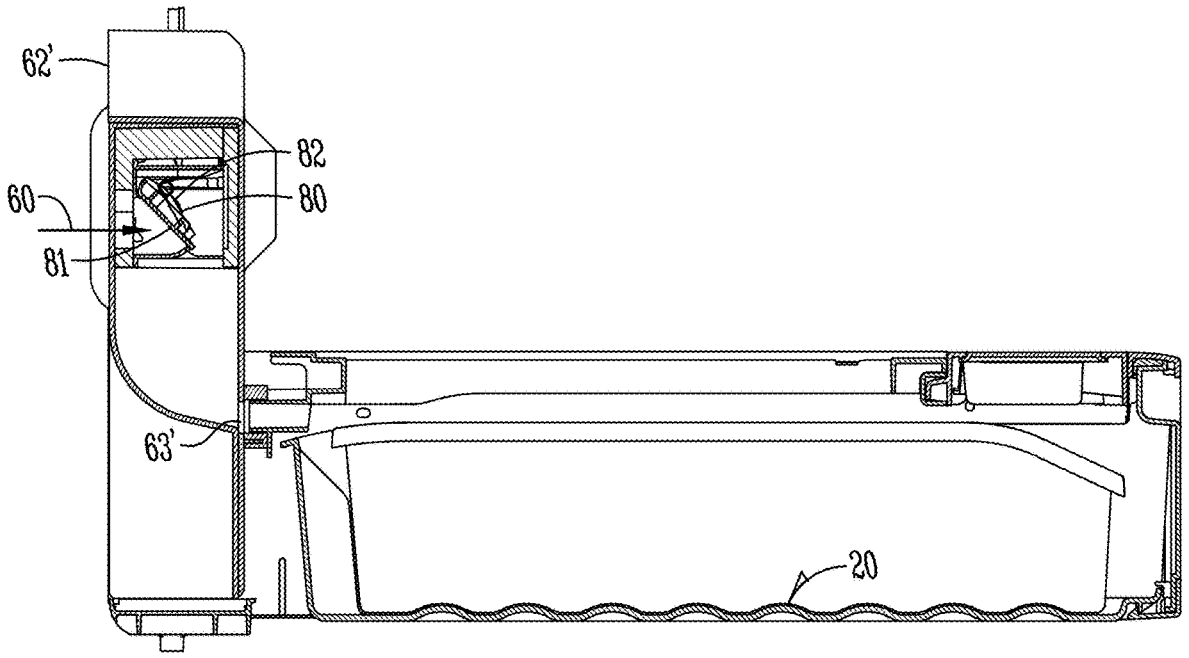
FIG. 12B is an enlarged sectional view along line 12B-12B of FIG. 12A showing a cold air pathway into the pantry drawer for the electronic version.

By reference to FIGS. 12A and B, and 13A and B, the method by which "cold" or "colder" pantry drawer 20 temperatures are achieved is illustrated.

Figure 13A:
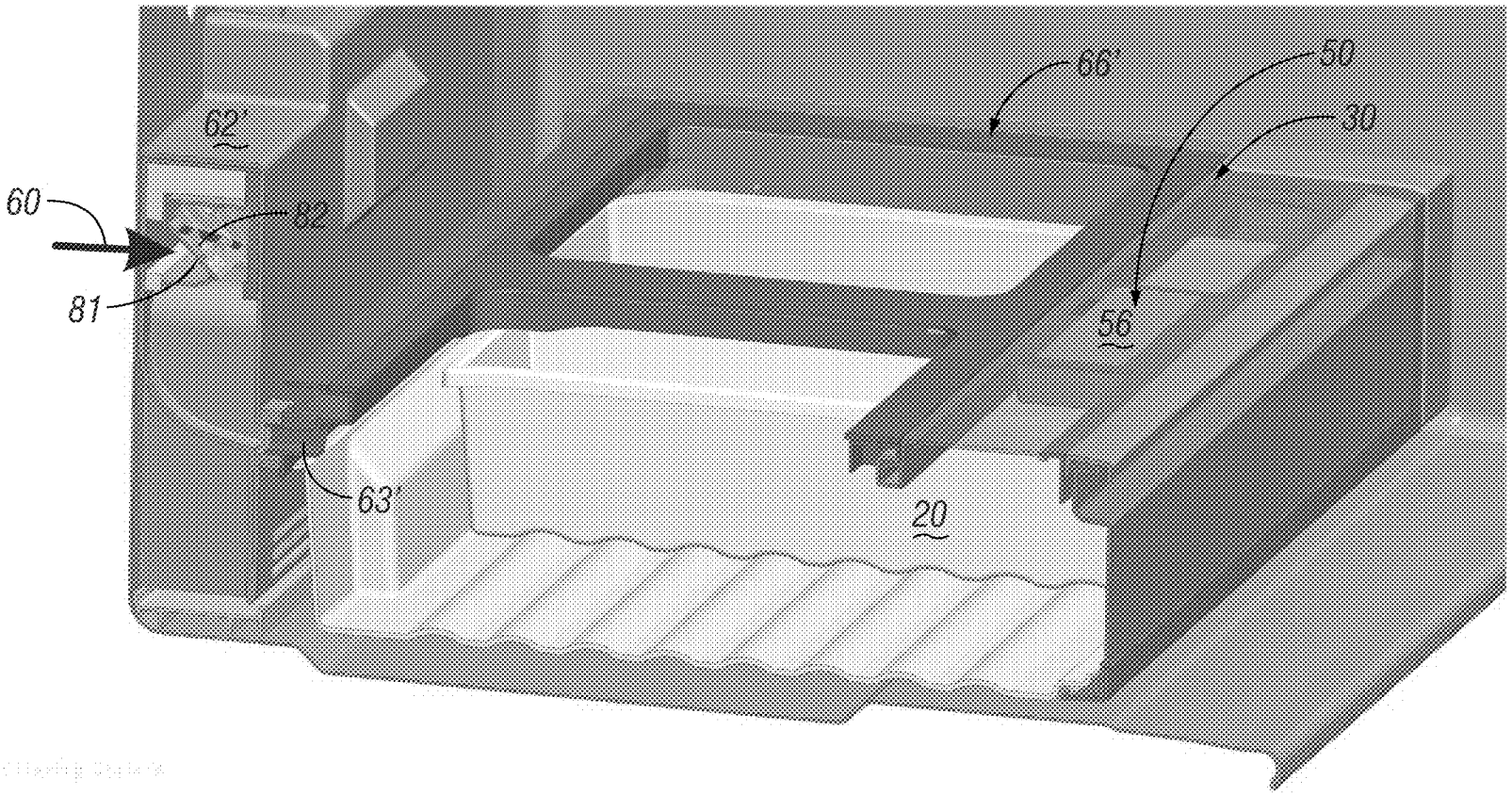
FIG. 13A is a perspective view with a section similar to section 12B-12B of FIG. 12A showing the control of cold air to the pantry drawer in the electronic module version; in particular, showing an electrically controlled damper 80 in closed position relative to a cold air path to the pantry drawer to promote pantry temperatures at an upper range of pantry drawer temperatures.

As shown in FIGS. 13A and B, cold air housing 62' would include a damper door 80 interposed in a cold air pathway to cold air outlet 63' to pantry drawer 20. Damper 80 is shown in a closed position in FIG. 13A. It is shown in an open position in FIG. 13B. Reference number 81 indicates its side away from pantry drawer 20; reference number 82 its side towards pantry drawer 20.

By methods well-known in the art, the relative dimensions of size of the air pathway 63' for cold air 60, the size of damper door 80, and temperature and flow rate of cold air 60' can be selected to achieve the approximate same range of 32° to 39° F. as the previously described manual control of pantry drawer 20 temperature. However, different ranges are possible of course.

As can be appreciated by those skilled in the art, damper door 80 can be moved between open and closed positions or positions therebetween in a variety of electrically actuated ways.

FIGS. 15-19A-C illustrates on example of electronic control with module 50.

Figure 14:
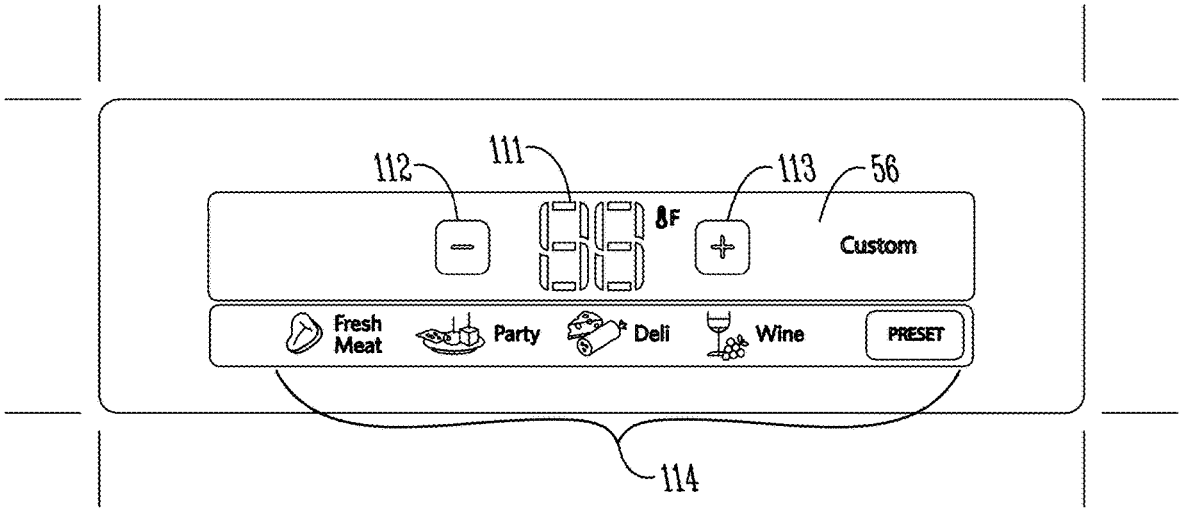
FIG. 14 is an enlarged top plan view of an outer fascia for the user interface for electronic control module 50, showing examples of icons for touch control by a user and a pantry temperature read-out display.
Figure 15:
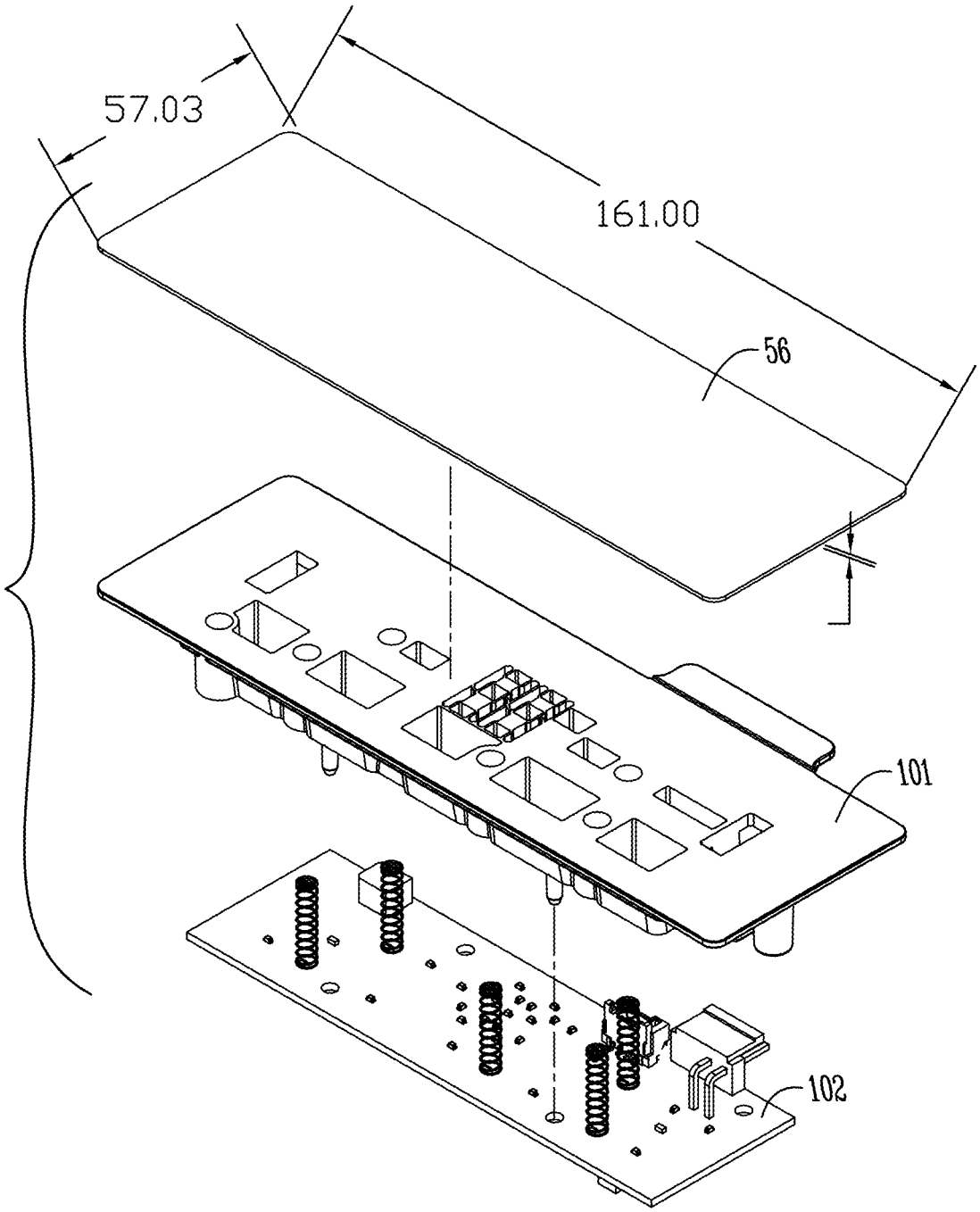
FIG. 15 is an enlarged exploded view of that fascia and a user interface control assembly 100 to translate user touches into electrical instructions.

User interface assembly 100 of FIG. 15 includes flexible fascia overlay 56 and underlying fascia circuit board 101 assembled on top of an underlying circuit board 102. As illustrated in FIG. 14, fascia overlay 56 includes a digital temperature readout 111 that can be informed by thermistor 107, "–" (minus) and "+" (plus) icons 112 and 113, and a set of icons or indicia 114 indicating specific types of food that might be stored in pantry drawer 20. As indicated, the user presses "minus" to lower pantry drawer 20 temperature and "plus" to raise it. Alternatively, the user could press one of icons 114 for temperatures pre-programmed for those specific types of food products. The circuitry 100 would instruct the appropriate actuation of damper 80 to predetermine the temperature settings that are programmed in the software for the circuitry 100. Note also there could be an elective "preset" different than the other choices 114. This might be user-programmable.

Figure 16:
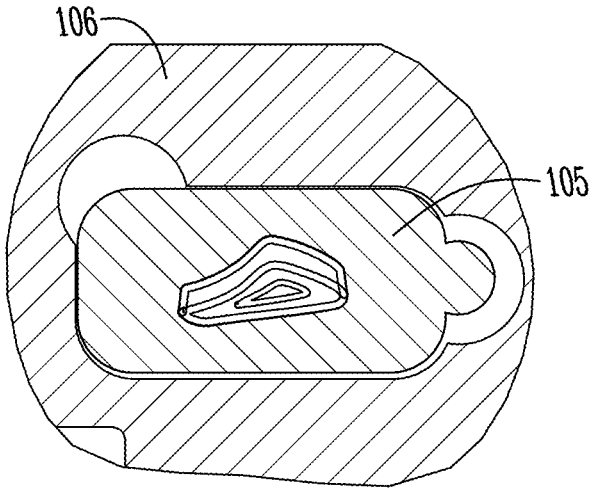
FIG. 16 is an enlarged diagrammatical depiction of one of the icon touch locations on user interface 100 illustrating how it can translate a touch into an electrical signal.
Figure 17:
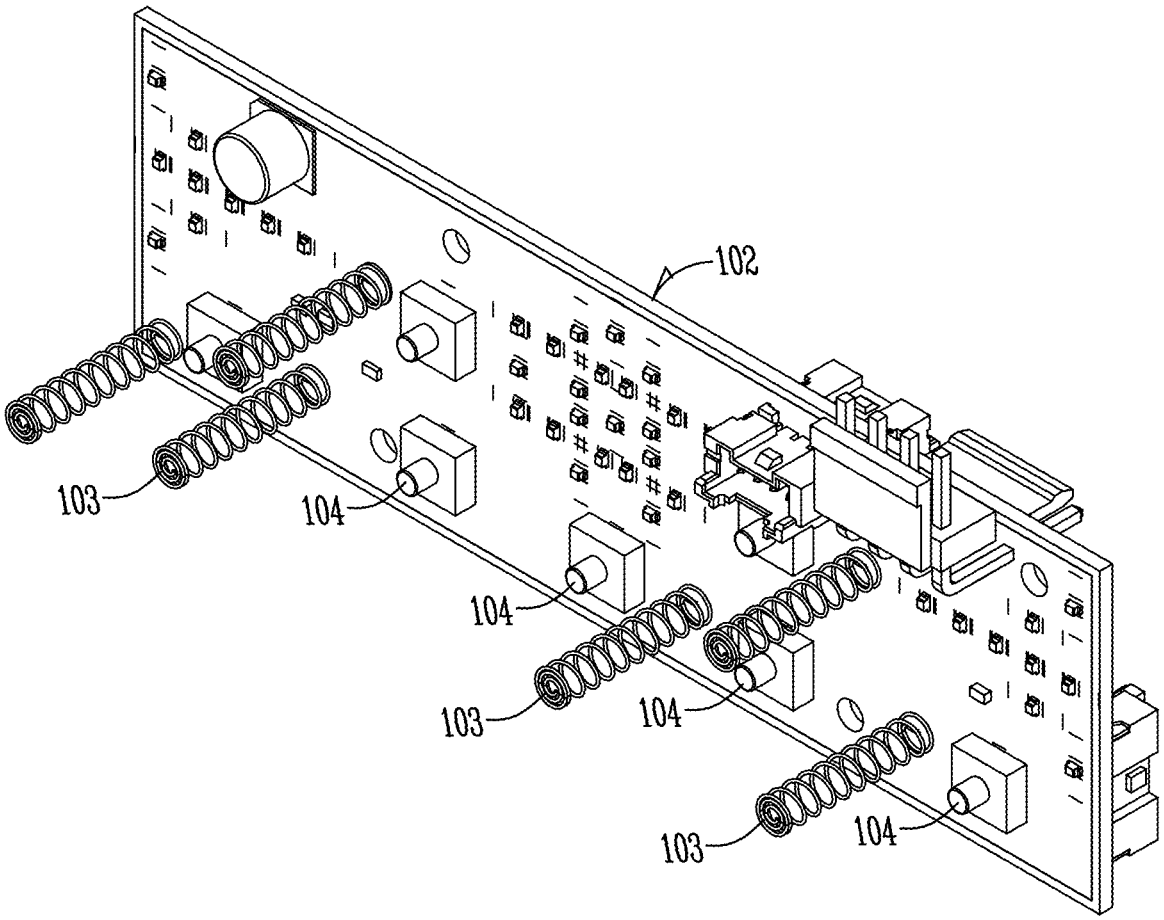
FIG. 17 is an isolated enlarged view of one part of the control assembly 100 illustrating LEDs that can backlight the icons on the fascia when touched.

FIGS. 16 and 17 illustrate how fascia overlay 56 could cooperate with the underlying boards 101 and 102 to transfer a touch by a user into an electrical instruction. A touch, for example, of the icon for meat (reference numeral 105 in FIG. 16) would complete a circuit between layers 101 and 102 of user interface 100 that would be interpreted by a controller to instruct opening or closing of damper 80 a pre-calibrated amount correlated to a predetermined target pantry drawer temperature. Touching another icon 114 would generate an electrical signal that would effect a damper door 80 position controlling cold air 60 pre-calibrated to pantry drawer temperature for that type of food product. LEDs 104 (FIG. 17) can light up when a certain icon is touched and backlight that icon. This shows the user the current selected icon.

The method of creating the appropriate electrical signal can vary, and it can be generated in different ways. The Figures illustrate a general known method of using conductive ink on and around the icons and helical conductors 103 between layers 101 and 102. Slight finger depression of, for example, icon 105 (for meat, see FIG. 16) would complete a circuit through helical conductor. User interface 100 would understand that completion of that circuit means to instruct damper door 80 to adjust position to one commensurate with a pre-set pantry temperature for that icon 105. Such a touch and complete-the-circuit method is known in the art. It is to be understood that other ways are possible.

Figure 18:
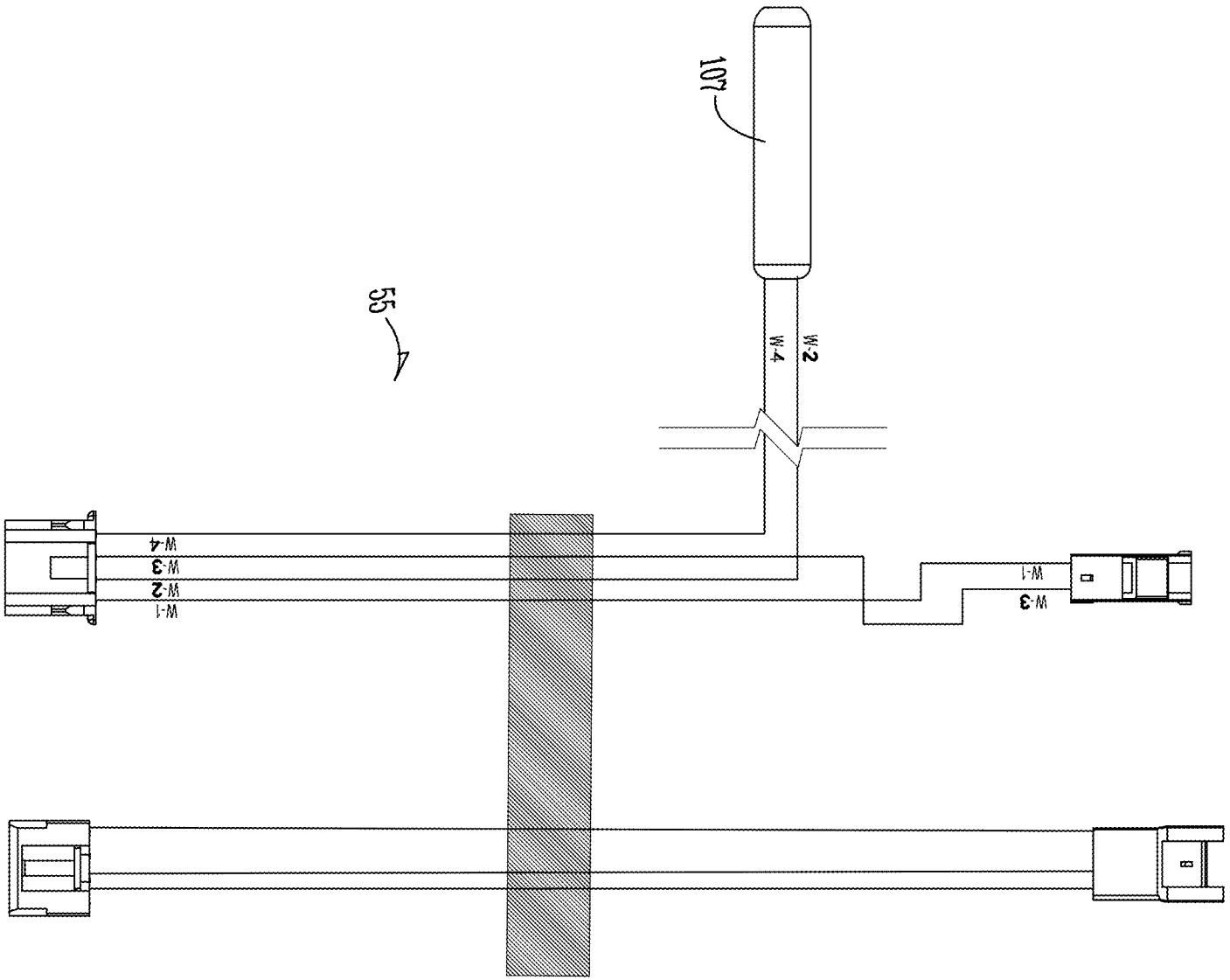
FIG. 18 is a diagram of a wiring harness that can communicate from user interface 100 at electronic module 50 to other components, including a controller that can actuate the opening and closing of a damper in a cold air path to the pantry drawer to regulate pantry drawer temperature.

FIG. 18 illustrates one example of the wiring assembly 55 that could be used with between layers of user interface assembly 100 and communicate with a controller in refrigerator appliance 10 that can, in turn adjust damper door 80. As shown in FIG. 18, the wiring assembly can also communicate actual pantry drawer temperature via thermistor 107 to allow the controller for refrigerator 10 to make automatic adjustments to try to maintain pantry drawer temperature within range and at or near the user-selected temperature.

Figure 13B:
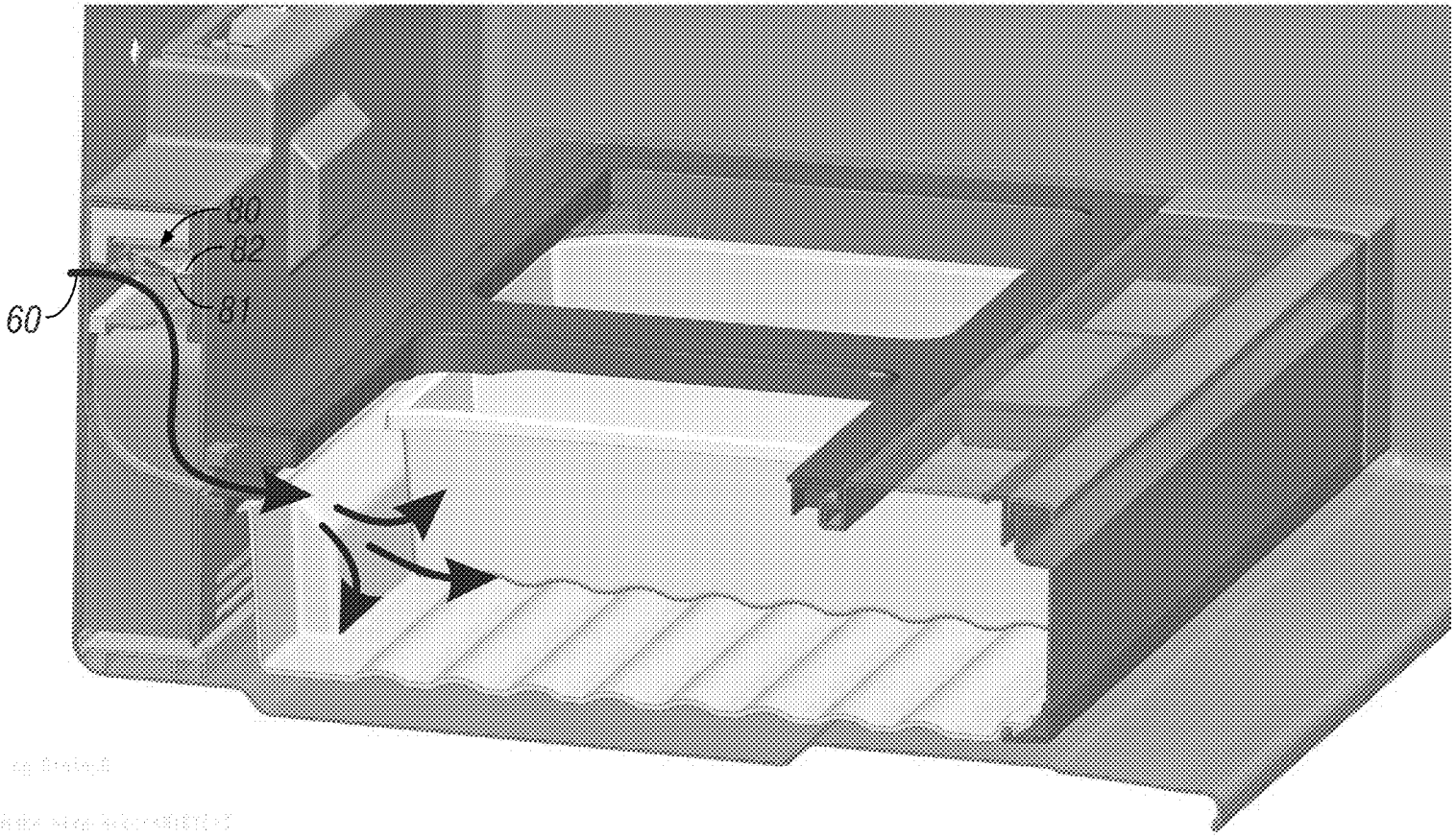
FIG. 13B is similar to FIG. 13A but shows the damper 80 in an open position for colder pantry temperatures to promote pantry drawer temperatures towards the lower end of the temperature range for the pantry drawer.
Figure 19A:
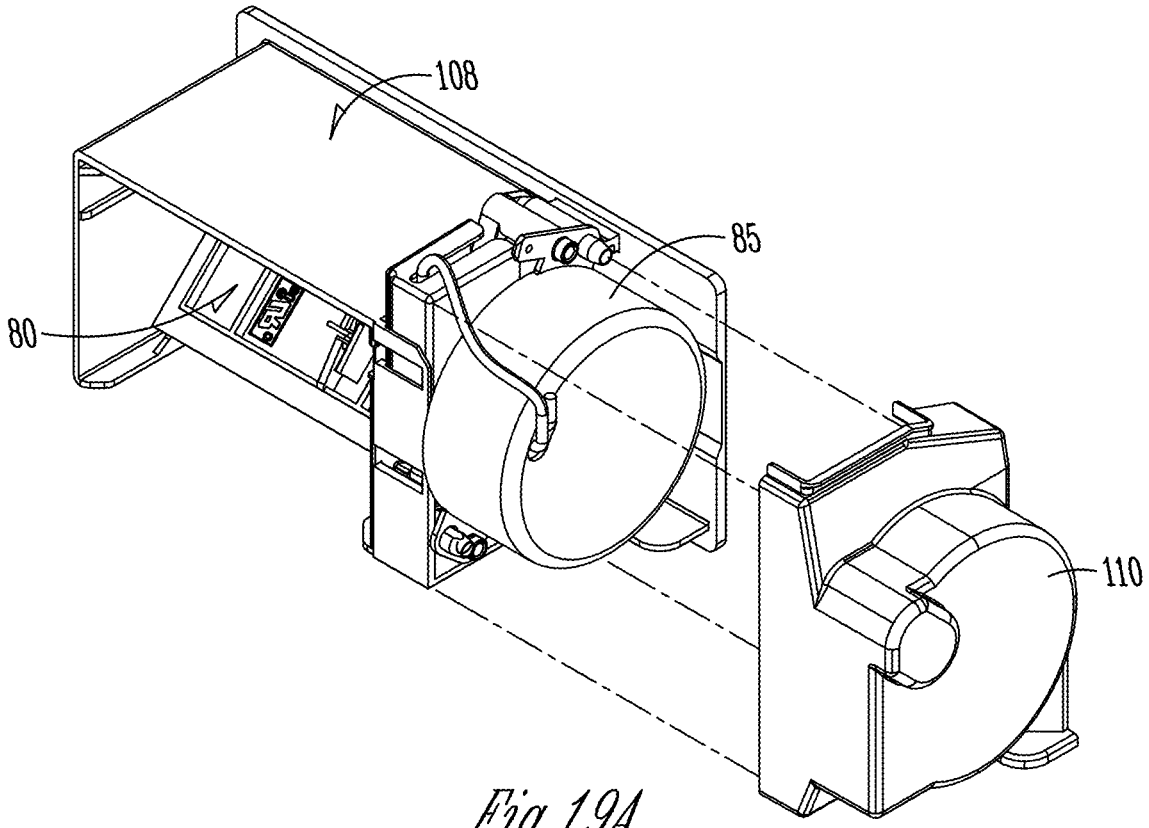
FIGS. 19A-C are various views of an electrical motor and damper module to control the cross-sectional area of the cold air path in the pantry door in the electronic version.
Figure 19B:
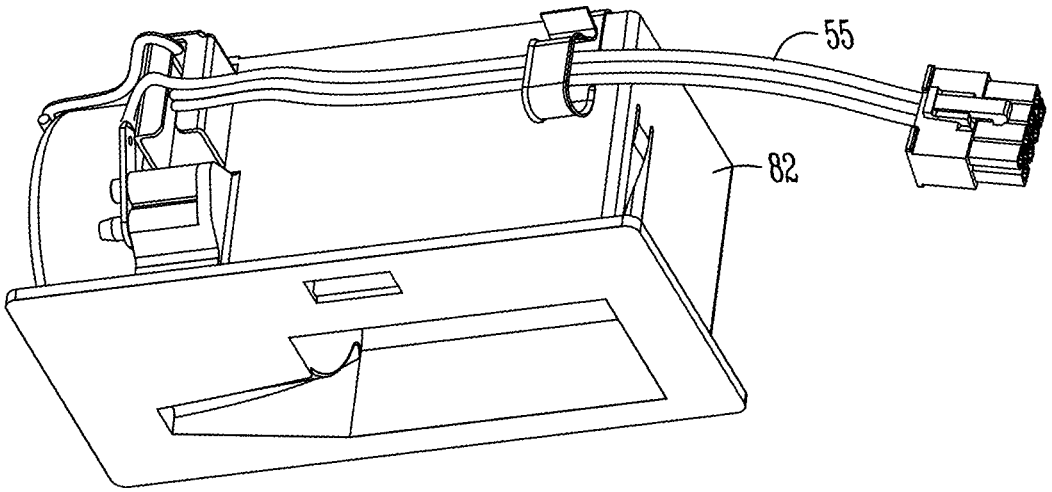
Figure 19C:
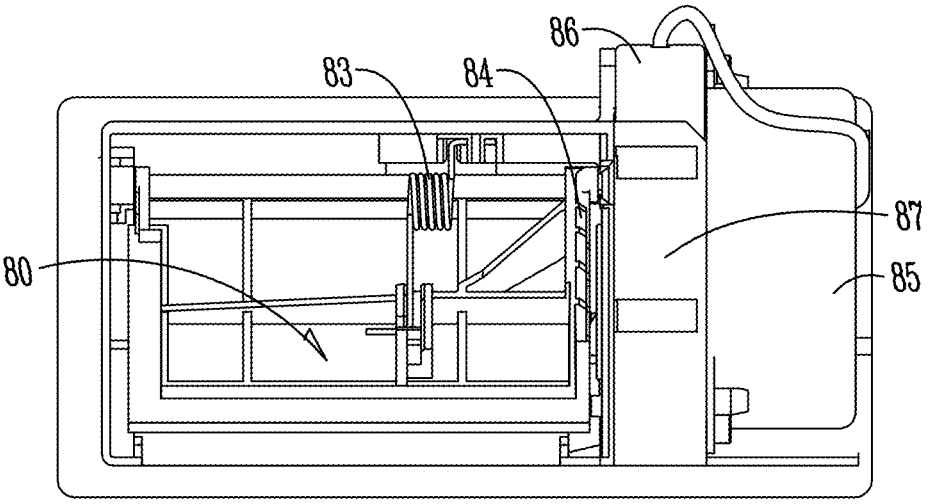

FIGS. 19A-C illustrate one possible way to control the position of damper door 80. In this example, damper door 80 would pivot in housing 108. Electric motor 109 could transmit rotation of power to a cam 84 (FIG. 19C) which in turn causes rotation of damper 80 against spring force of spring 83. The cam could be selected relative to motor 85 to pivot damper 80 over a range. One example would be between completely closed (FIG. 13A) and completely open (FIG. 13B). Positions in between could be commensurate with different temperatures within the range promoted by fully open or fully closed. Pantry drawer temperature is controlled by controlling the amount of or rate of cold air 60 allowed to enter the space of pantry drawer 20. Uncovering of the cold air path into pantry drawer 20 promotes colder temperatures. Motor cover 110 could be placed over motor 109. That whole assembly could be easily installed in the cold air housing 62' at the back of cabinet 12 of refrigerator appliance 10.

Damper door 80 is fully closed at FIG. 13A. The outboard side 81 of door 80 would block cold air 60 from entering pantry drawer 20 by appropriate action of motor 85 to turn door 80 to its blocking position. In FIG. 13B, door is fully open. Door 80 is rotated up (outboard and inboard sides 81 and 82 respectively of door 80 are substantially out of the cold air pathway to pantry drawer 20). Cold air 60 can flow into pantry drawer 20. Motor 85 can move damper door 80 to positions between fully open and fully closed to effect a proportional response in cold air flow to promote temperatures in between opposite ends of the intended temperature range (in this embodiment 32 to 39° F.).

As can be appreciated, although there are differences in the components and some of the placements and positionings in the electronic version of pantry drawer 20 temperature control versus manual control, the same pantry drawer cover 30 is used for the electronic module 50. Wiring from module 50 does not interfere materially with the operation of pantry drawer 20. Relatively inexpensive motor and damper assembly can be placed behind pantry drawer 20. Module 50 contains most of the electronic and electrical controls to then instruct adjustment of damper 80 by motor 109.

These components are not complex and are relatively economical. Substantial functionality can be programmed into the circuitry of component 100, which minimizes the number of parts and components. Substitution of H-shaped support 66' for similar part 66 of FIG. 5 does not involve significant cost or increased complexity. Substitution of side plates 27L' and 27R does not increase costs or complexity substantially either.

As can be appreciated by those skilled in the art, the specific components and specifications of components to implement the electronic version can be selected according to desire or need.

ALTERNATIVES & OPTIONS

As can be appreciated by those skilled in the art, variations to the exemplary embodiment described above are possible. Variations on size, configuration, materials, and locations are possible.

One example of an alternative embodiment of the invention as follows. Some refrigerators have external drawers that have their own separate insulated compartment in cabinet 12 apart from cooling chamber 14 or bottom freezer 18. As indicated at 40 or 50 in FIG. 1, such an external drawer 20 could include some sort of surface or plate across its top when it is slid upon with a receiver for module 40 or 50 (which could essentially be the same or very similar to module 40 or 50). By similar structure and technique, either manual mechanical temperature control or manual electronic temperature control could be added for that enclosed space in appliance 10.

Another example of an alternative application of the invention is as follows. Even a smaller drawer inside of refrigeration space 14 could have a surface or panel or cover 30 with a receiver that could accept either manual or electronic temperature control 40 or 50. By similar technique, temperature adjustment could be accomplished at even smaller substantially enclosed space.

Furthermore, other optional features could be included with any of the embodiments. For example, one or more heaters could be placed in the enclosed space for temperature control that could assist in raising or maintaining a selected temperature. Such heaters are commercially available.

Other options or features could include variations obvious to those skilled in the art. As will be appreciated by those skilled in the art, the invention can take many different forms and embodiments. The foregoing specific embodiments are neither inclusive nor exclusive of the forms and embodiments the invention can take.

What is claimed is:

1. A temperature control assembly for a refrigeration appliance comprising:

a. a surface positionable in or on the refrigeration appliance;

b. a receiver in the surface, wherein the receiver comprises an opening in the surface having a perimeter of a defined shape or configuration, and having supporting structure at or around the perimeter of the opening;

c. a manual module removably fittable into the receiver, the module comprising a housing having at least a portion which is complementarily fittable into and stationary within the perimeter and supporting structure and self-centering to the receiver, the module including a translation subassembly to translate temperature control from the housing to a temperature control unit, the temperature control unit comprising a damper away from the surface and the translation subassembly comprising direct mechanical linkage to the damper.

2. The assembly of claim 1 wherein the surface comprises a plate, wall, or door with or without a window.

3. The assembly of claim 1 wherein the surface is at or near an enclosed or substantially enclosed space for temperature control, the space comprising a drawer.

4. The assembly of claim 3 wherein the drawer comprises a pantry drawer of substantially the width and depth of a cold food portion of a refrigerator.

5. The assembly of claim 1 wherein the manual control element comprises a manual hand control element adapted for connection to the mechanical linkage to the damper.

6. The assembly of claim 1 wherein the electronic control element comprises a manually selectable interface operatively connected to generate an electrical signal corresponding to the manual selection.

7. The assembly of claim 6 further comprising a temperature display.

8. The assembly of claim 1 wherein the surface is at or near a refrigerator door.

9. The assembly of claim 8 in combination with a refrigeration appliance.

10. A temperature control system for independent control of temperature for an enclosed space inside a refrigeration appliance comprising:

a. a refrigeration appliance comprising a cabinet;

b. an enclosable space inside a cabinet;

c. a surface at or near the enclosable space;

d. a receiver in the surface wherein the receiver comprises an opening in the surface having a perimeter of a defined shape or configuration, and having supporting structure at or around the perimeter of the opening;

e. a set of interchangeable modules each fittable into and stationary within the perimeter and supporting structure and self-centering to the receiver comprising:

i. a first module comprising a housing and a manually adjustable control coupled to the housing, the manually adjustable control in operative connection to a mechanical linkage to translate movement of the manually adjustable control to opening size of a damper to the enclosed space;

ii. a second module comprising a housing and a user interface coupled to the housing, the user interface which converts a manual touch or selection into an electrical signal and operatively connected to a controller of an actuator to control the opening of a damper.

11. The system of claim 10 wherein the refrigeration appliance comprises a French-door style bottom freezer, side-by-side bottom freezer, top freezer, or solely cold refrigeration appliance.

12. The system of claim 10 wherein the enclosable space is within the cold food section of the cabinet.

13. The system of claim 10 wherein the surface comprises a panel, plate, door or drawer or wall.

14. The system of claim 10 wherein the manually adjustable control comprises a slide having a range of motion.

15. The system of claim 14 wherein the linkage comprises a rod.

16. The system of claim 10 wherein the user interface is a touch surface or actuated buttons.

17. The system of claim 16 wherein the electrical signal is communicated by electrical wire or cable.

18. The system of claim 10 wherein the enclosable space comprises a pantry drawer.

19. The system of claim 10 further comprising a heater in the enclosable space operatively connected to the controller.

20. A method of controlling temperature inside an enclosable space of a refrigeration appliance comprising:

a. manufacturing a refrigeration appliance with an enclosable space and a surface including a receiver;

b. manufacturing a plurality of interchangeable modules, a first of said plurality of modules including a manual temperature control coupled to a manual housing, a second comprising a manual temperature control coupled to an electric housing that converts to an electrical signal, wherein each of the manual housing and the electric housing have a complementary fit into the receiver;

c. selecting one of the manual and electric modules;

d. mounting the selected module in the receiver, wherein when the module is mounted within the receiver, the housing remains stationary within the receiver.

* * * * *